US007226152B2

(12) United States Patent
Matsushita et al.

(10) Patent No.: US 7,226,152 B2
(45) Date of Patent: Jun. 5, 2007

(54) IMAGE FORMING APPARATUS

(75) Inventors: Masaki Matsushita, Ikoma-gun (JP); Hirokazu Nakamura, Nara (JP); Naozumi Ueno, Ikoma (JP); Hisashi Yoshimura, Nara (JP); Takashi Gotoh, Nara (JP); Hiroshi Ishii, Osaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 240 days.

(21) Appl. No.: 10/766,777

(22) Filed: Jan. 27, 2004

(65) Prior Publication Data

US 2004/0217995 A1 Nov. 4, 2004

(30) Foreign Application Priority Data

Jan. 29, 2003 (JP) ..... 2003-020895

(51) Int. Cl.
*B41J 2/175* (2006.01)

(52) U.S. Cl. ..... 347/85

(58) Field of Classification Search ..... 347/7, 347/19, 85, 86, 87, 92, 93
See application file for complete search history.

(56) References Cited

U.S. PATENT DOCUMENTS 5,565,899 A * 10/1996 Sugimoto et al. ..... 347/30
6,036,305 A * 3/2000 Nagasaki et al. ..... 347/86

FOREIGN PATENT DOCUMENTS

| | | |
|---|---|---|
| JP | 03-288654 | 12/1991 |
| JP | 09-240019 | 9/1997 |
| JP | 10-278300 | 10/1998 |
| JP | 2002-036557 | 2/2002 |
| JP | 2002-067353 | 3/2002 |

OTHER PUBLICATIONS

U.S. Appl. No. 10/662,354, filed Sep. 16, 2003, M. Matsushita et al.

* cited by examiner

*Primary Examiner*—Anh T. N. Vo
(74) *Attorney, Agent, or Firm*—Edwards Angell Palmer & Dodge LLP; David G. Conlin; Lisa Swiszcz Hazzard

(57) ABSTRACT

An image forming apparatus in which ink depletion detection accuracy will not be deteriorated even if an air bubble is created in an ink supplying path. The image forming apparatus is provided with (a) an ink storage section for storing ink therein, (b) an ink supplying path for supplying, to a print head, the ink stored in the ink storage section, and (c) an electrode for detecting whether the ink is present or absent in the ink supplying path, an amount of the ink supplied into the ink supplying path being 1.0 cc or less per minute.

21 Claims, 23 Drawing Sheets

Ps: NEGATIVE PRESSURE DUE TO VISCOSITY WHEN INK TANK IS FULL OF INK
Pi: INK TANK WATER HEAD PRESSURE (TANK WATER PRESSURE)
PE: CRITICAL PRESSURE DUE TO INK ABSORBING BODY WHEN INK TANK IS EMPTY OF INK
Pm: CRITICAL PRESSURE DUE TO FILTER $$Rd = \int_0^X \frac{1}{\left\{ 2\sqrt{(dm/2)^2 - X^2} \right\}^4} \, dX$$

$$Rm = \int_0^X \frac{1}{dm^4} \, dX$$

$$Pt = 4\eta\cos\theta / d$$

$Pt = 4\eta / d$

IMAGE FORMING APPARATUS

This Nonprovisional application claims priority under 35 U.S.C. § 119(a) on Patent Application No. 2003/20895 filed in Japan on Jan. 29, 2003, the entire contents of which are hereby incorporated by reference.

FIELD OF THE INVENTION

The present invention relates to an image forming apparatus provided with an ink storage section for storing ink therein, particularly, to an ink jet recording apparatus as an image forming apparatus.

BACKGROUND OF THE INVENTION

The ink jet recording apparatus is an image forming apparatus for printing by jetting out (spray) ink on a sheet functioning as a recording sheet. The ink jet recording apparatus is generally provided with an ink cartridge including an ink tank. The ink is supplied from the ink cartridge to a print head. Then, the ink is jetted out from the print head onto the sheet.

In using such ink jet recording apparatus, it is necessary to replace the ink cartridge when the ink in the ink cartridge runs out (depletes). Thus, it is necessary to detect (measure) and inform how much ink is left in the ink cartridge (ink remaining amount).

In view of this, various ink cartridges have been suggested, in which the ink remaining amount can be detected. For example, Japanese Publication of Unexamined Patent Application, Tokukaihei, No. 3-288654 (published on Dec. 18, 1991) discloses an ink cartridge provided with an ink absorbing foam material in an ink tank, a filter in an ink supplying path that connects the ink tank and a print head, and electrodes in a downstream of the filter, that is, at a location between the filter and an ink jetting outlet, the electrodes detecting whether the ink is present or absent in the ink supplying path.

In an ink jet recording apparatus using such an ink cartridge, the ink is supplied from the ink cartridge to the print head by a negative pressure applied via the filter from a print head side, which is an ink spraying outlet side.

The ink jet recording apparatus using such ink cartridge is so arranged that detection of the ink in the ink supplying path is carried out by using a current flowing between the electrodes. That is, the ink becomes absent in the ink supplying path when an ink remaining amount becomes little, thereby allowing no current to flow between the electrodes. It is detected that no current flows between the electrode. Thereby, it is judged as "ink empty (ink depletion)", that is, it is judged that the ink has run out.

However, in applying the negative pressure via a filter from the print head side (the ink spraying outlet side) in order to suck out the ink, there is a possibility that printing quality would be deteriorated if the air is sucked in from the print head side.

In order to solve this problem, various methods to prevent the air from being entrained into the ink from the print head have been suggested. For example, in Japanese Publication of Unexamined Patent Application, Tokukai, No. 2002-36557 (published on Feb. 5, 2002), a buoyant force applied on an air bubble in an ink supplying chamber is set to be larger than a drag force given by velocity of flow of ink, thereby preventing the air bubble from growing in the ink supplying chamber.

Moreover, Japanese Publication of Unexamined Patent Application, Tokukai, No. 2002-67353 (published on Mar. 5, 2002) discloses an arrangement in which a first filter for preventing ink leakage and a second filter, which is finer than the first filter, for removing foreign materials are provided in an ink supplying path in this order from an upstream of the ink supplying path.

However, a larger air bubble is easy to break. Thus, in the art described in Japanese Publication of Unexamined Patent Application, Tokukai, No. 2002-36557, there is a possibility that an survived air bubble, which has not broken, enters the ink supplying chamber.

Further, in the art described in Japanese Publication of Unexamined Patent Application, Tokukai, No. 2002-36557, there is a problem that the air bubble gives influence on detection of ink depletion.

Moreover, in Japanese Publication of Unexamined Patent Application, Tokukai, No. 2002-67353, there is a problem that the second filter, which is finer than the first filter, produces a smaller air bubble, thereby deteriorating accuracy in detection of the ink depletion.

SUMMARY OF THE INVENTION

The present invention, in view of the aforementioned conventional problems, has an object of providing an image forming apparatus in which ink depletion detection accuracy is not deteriorated (maintained) even if an air bubble is created in an ink supplying path.

In order to attain the object, an image forming apparatus of the present invention is provided with an ink storage section (for example, an ink tank provided in an ink cartridge) for storing ink therein; an ink supplying path for supplying, to a print head, the ink stored in the ink storage section; and an electrode for detecting whether the ink is present or absent in the ink supplying path, an amount of the ink supplied (ink supply amount) into the ink supplying path being 1.0 cc or less per minute.

The experiments conducted by the inventors of the present invention confirmed that the arrangement in which the ink supply amount is 1.0 cc or less per minute prevents the S/N ratio of the detecting electrode from being lowered when the air bubble is created in the ink supplying path in supplying the ink. Thus, according to the arrangement, it is possible to provide an image forming apparatus in which ink depletion detection accuracy is not deteriorated even if an air bubble is created in an ink supplying path.

In order to attain the object, an image forming apparatus of the present invention is provided with an ink storage section for storing ink therein; an ink supplying path for supplying, to a print head, the ink stored in the ink storage section; and an electrode for detecting whether the ink is present or absent in the ink supplying path, the image forming apparatus satisfying:

$$(4\cdot Q/(\pi\cdot d))/\nu \leqq 2,$$

where $\nu(m^2/s)$ is a dynamic viscosity of the ink, d(m) is a diameter of the ink supplying path, $Q(m^3/s)$ is an average ink supply amount.

According to the arrangement, it is possible to attain that the ink supply amount is 1.0 cc or less per minute, whereby it is possible to prevent the S/N ratio of the detecting electrode from being lowered when the air bubble is created in the ink supplying path in supplying the ink. Thus, according to the arrangement, it is possible to provide an image forming apparatus in which ink depletion detection accuracy is not deteriorated even if an air bubble is created in an ink supplying path.

In order to attain the object, an image forming apparatus of the present invention is provided with an ink storage section for storing ink therein; an ink supplying path for supplying, to a print head, the ink stored in the ink storage section; an electrode for detecting whether the ink is present or absent in the ink supplying path; and first and second filters in the ink supplying path, the first and second filters having different filtration accuracies, the first filter located upstream to the second filter, the second filter has a larger filtration accuracy than the first filter.

The experiments conducted by the inventors of the present invention reveled that the arrangement in which the second filter has a higher filtration accuracy than the first filter, prevents the S/N ratio of the detecting electrode from being lowered when the air bubble is created in the ink supplying path in supplying the ink.

Moreover, a greater ratio at which the filtration accuracy of the second filter is smaller than the filtration accuracy of the first filter gives smaller diameter of an air bubble created by the second filter on the downstream side after the air bubble created by the first filter on the upstream side passes the filter second. Thus, the greater ratio at which the filtration accuracy of the second filter is smaller than the filtration accuracy of the first filter leads to a lower S/N ratio of the ink detecting electrodes thereby reducing an ink depletion detection accuracy.

Thus, according to the arrangement, it is possible to provide an image forming apparatus in which ink depletion detection accuracy is not deteriorated even if an air bubble is created in an ink supplying path.

For a fuller understanding of the nature and advantages of the invention, reference should be made to the ensuing detailed description taken in conjunction with the accompanying drawings.

BRIEF DESCRIPTION OF THE DRAWINGS

FIG. 4(*b*) is a cross sectional view illustrating the ink cartridge of FIG. 4(*a*), from which the ink supplying path is detached. FIG. 4(*c*) is a cross sectional view illustrating an arrangement of detecting electrodes.

FIG. 23(*b*) is a cross sectional view of the ink supplying path showing an air bubble created in the ink supplying path when an amount of the ink supplied is large.

DESCRIPTION OF THE EMBODIMENTS

With reference to FIGS. 1 to 25, the following describes one embodiment of the present invention.

Figure 2:
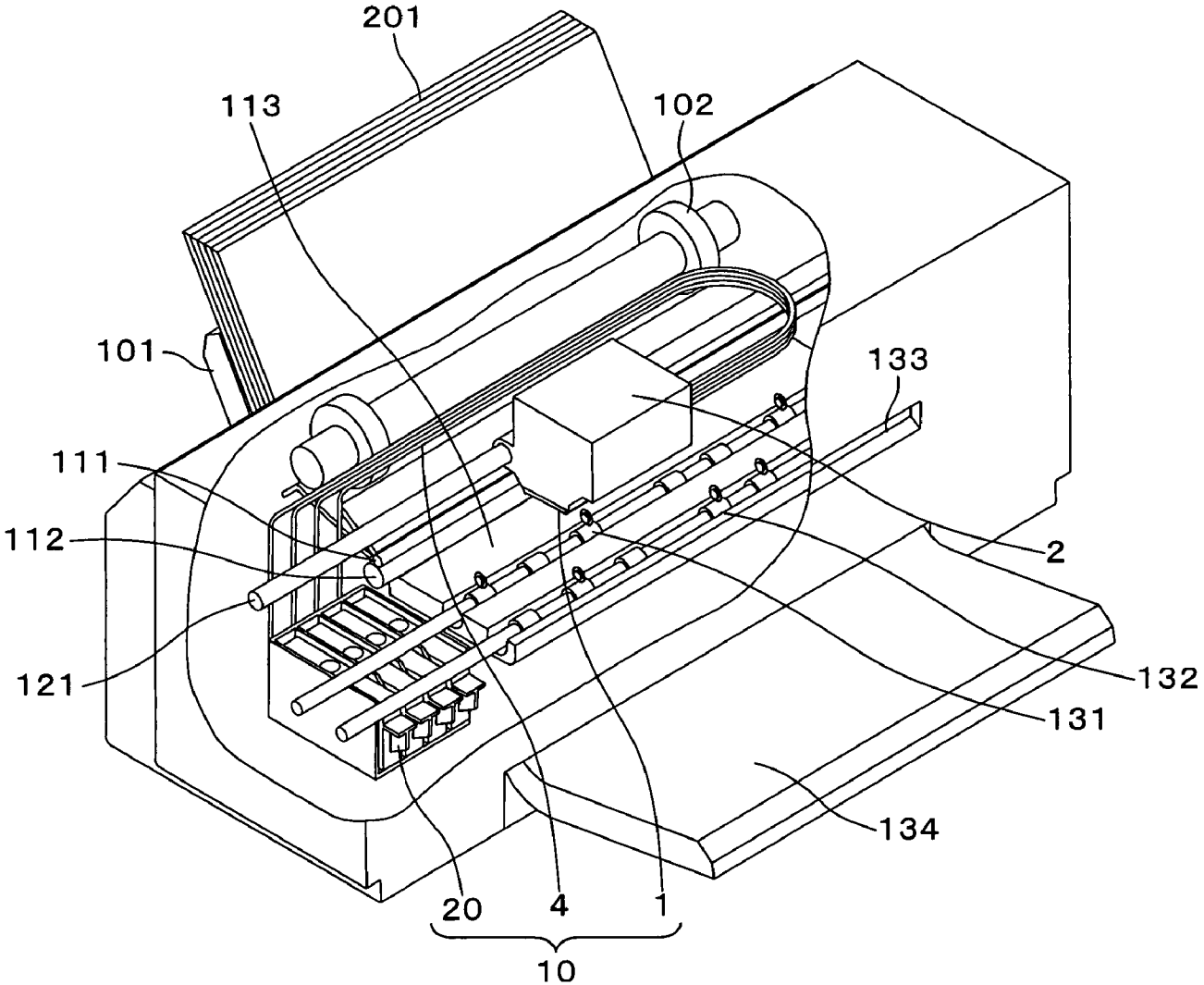
FIG. 2 is a perspective view of a broken perspective view of an overall arrangement of the ink jet recording apparatus.

As shown in FIG. 2, an ink jet recording apparatus of the present embodiment functions as an image forming apparatus and includes a feeding section, a separating section, a conveying section, a printing section, and an ejecting section.

The feeding section, which includes a feeding tray 101 and a pickup roller 102, feeds recording sheets 201 in printing. When printing is not performed, the feeding section functions as a sheet storage for storing the sheets 201 therein.

The separating section supplies, sheet-by-sheet to the printing section, the sheets 201 fed by the feeding section. The separating section includes a feeding roller and a separator (neither is shown). The separating apparatus is so set that the friction between a sheet and a pad section, which is a point of contact with the sheet 201, is larger than the friction between the sheets 201. The feeding roller is so set that the friction between the feeding roller and the sheet 201 is larger than the friction between the pad and the sheet 201 or between the sheets 201. As a result, even if two sheets 201 are sent to the separating section, it is possible to separate the sheets 201 and send only the upper sheet 201 to the conveying section.

The conveying section conveys, to the printing section, the sheets 201 supplied sheet-by-sheet by the separating section. The conveying section includes a guiding board (not shown) and a pair of rollers such as a conveying press roller 111 and a conveying roller 112. The roller pair sets the sheet 201 in position when the sheet 201 is being conveyed to the space between a print head 1 and a platen 113, so that the ink supplied by the print head 1 is sprayed onto appropriate positions of the sheet 201.

The printing section performs printing on the sheet 201 supplied by the roller pair of the conveying section. The printing section includes the print head 1, a carriage 2 in which the printer head 1 is installed, a guiding bar 121 for guiding the carriage 2, an ink cartridge 20 for supplying ink to the print head 1, a platen 113 on which the sheet 201 is placed during printing, an ink supplying path 3 that is constituted of an ink supplying tube 4. The ink supplying path 3 constituted of the ink supplying tube 4 connects the print head 1 and the ink cartridge 20. The ink supplying path 3 supplies the ink to the print head 1 from the ink cartridge 20. The print head 1, the ink cartridge 20, and the ink supplying path 3 constitute an ink supplying unit 10, which is described later.

The ejecting section ejects the sheet 201 out of the ink jet recording apparatus after printing. The ejecting section includes ejecting rollers 131 and 132 and an ejection tray 134.

The ink jet recording apparatus of the foregoing structure operates as follows to perform printing.

First, the ink jet recording apparatus receives a request for printing from a computer or like apparatus (not shown), the printing request being made according to image information. After receiving the request for printing, the ink jet recording apparatus sends sheets 201 on the feeding tray 101 from the feeding section, using the pickup roller 102.

Next, the sheet 201 that has been sent is conveyed by the feeding roller through the separating section, and is sent to the conveying section. The conveying section conveys the sheet to the space between the print head 1 and the platen 113, using the conveying press roller 111 and the conveying roller 112 making up the roller pair.

In the printing section, ink is sprayed from spraying nozzles (ink spraying nozzle) 1*a* (see FIG. 21) of the print head 1 onto the sheet 201 on the platen 113, in accordance with the image information. In printing as such, the sheet 201 is temporarily stopped on the platen 113. While the ink is being sprayed, the carriage 2 makes a scan for one line in a main-scanning direction by being guided with the guiding bar 121.

After that, the sheet 201 is moved by a certain distance in a sub-scanning direction on the platen 113. These operations are consecutively carried out in the printing section in accordance with the image information, until printing is finished with respect to the entire sheet 201.

The printed sheet 201 pass through an ink drying section, and is ejected by the ejection rollers 131 and 132 to the ejection tray 134 via a sheet ejecting opening 133. Then, the sheet 201 is supplied to a user as a printed document.

Figure 3:
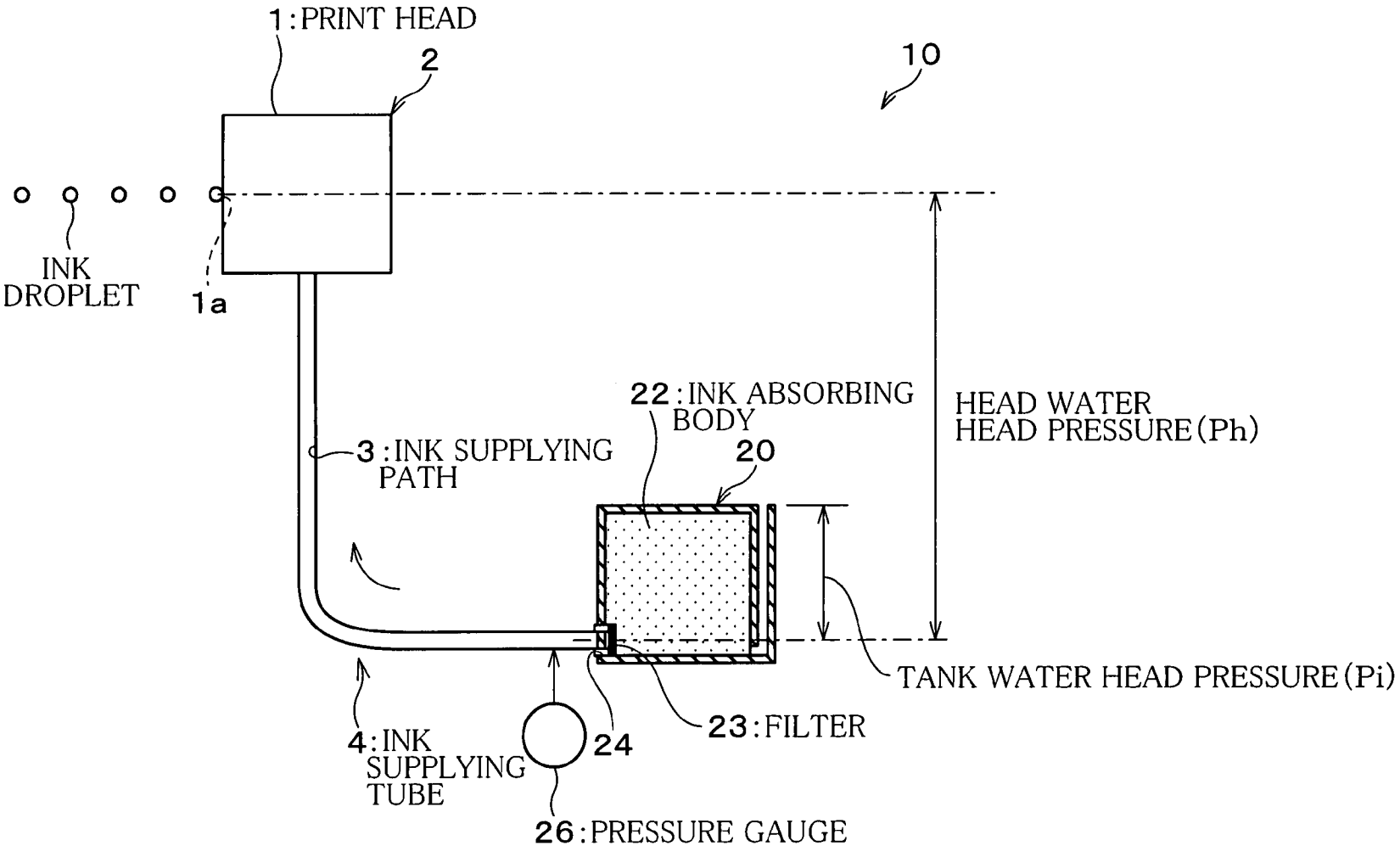
FIG. 3 is a schematic diagram illustrating an arrangement of an ink supply apparatus of the ink jet recording apparatus.
Figure 4:
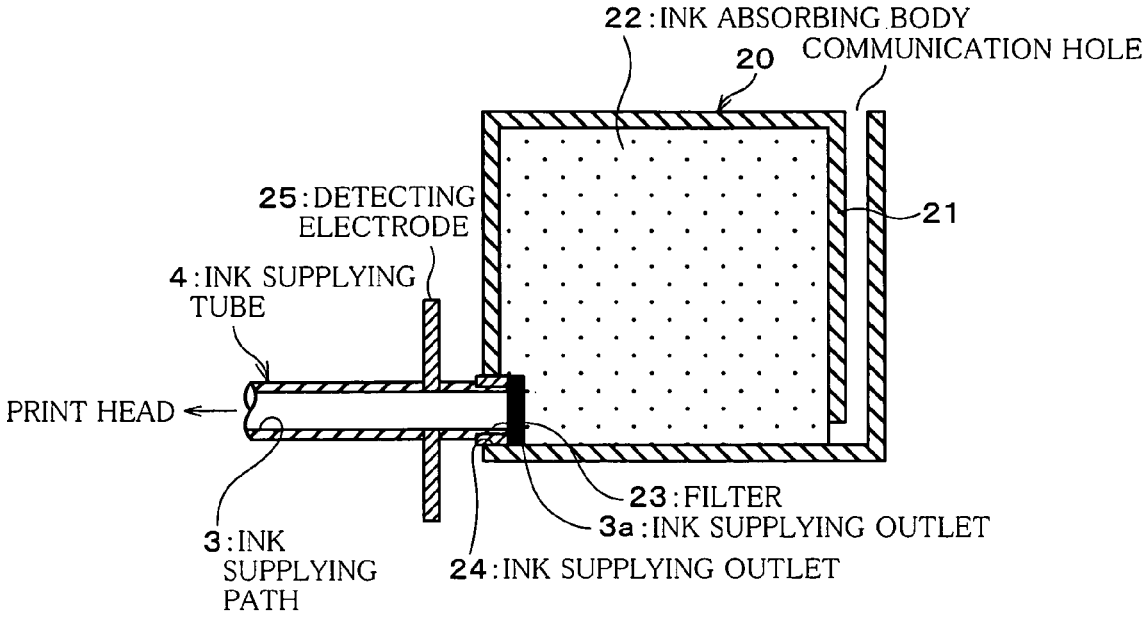
FIG. 4(*a*) is a cross sectional view illustrating an arrangement of an ink cartridge of the ink jet recording apparatus.
Figure 4:
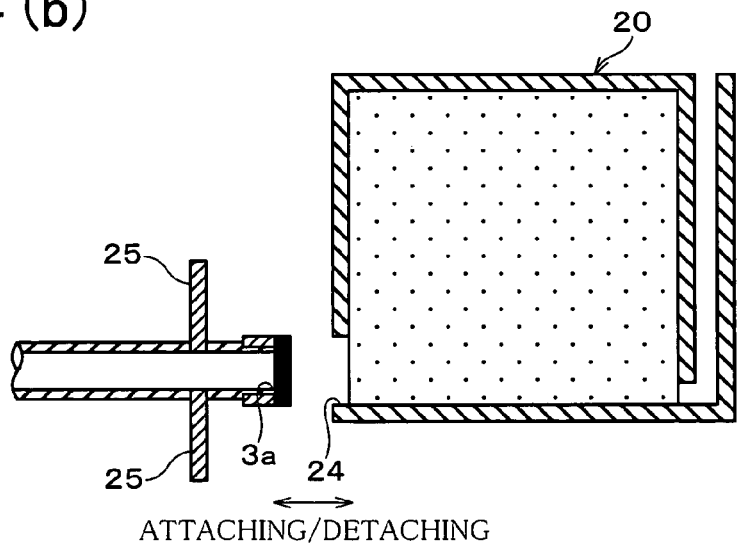
Figure 4:
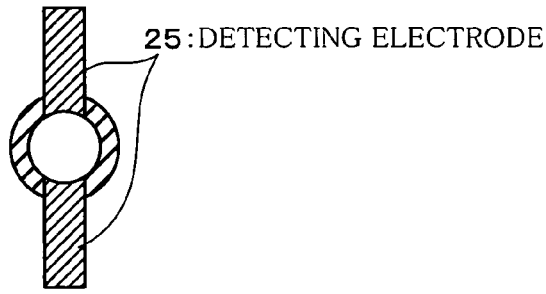
Figure 5:
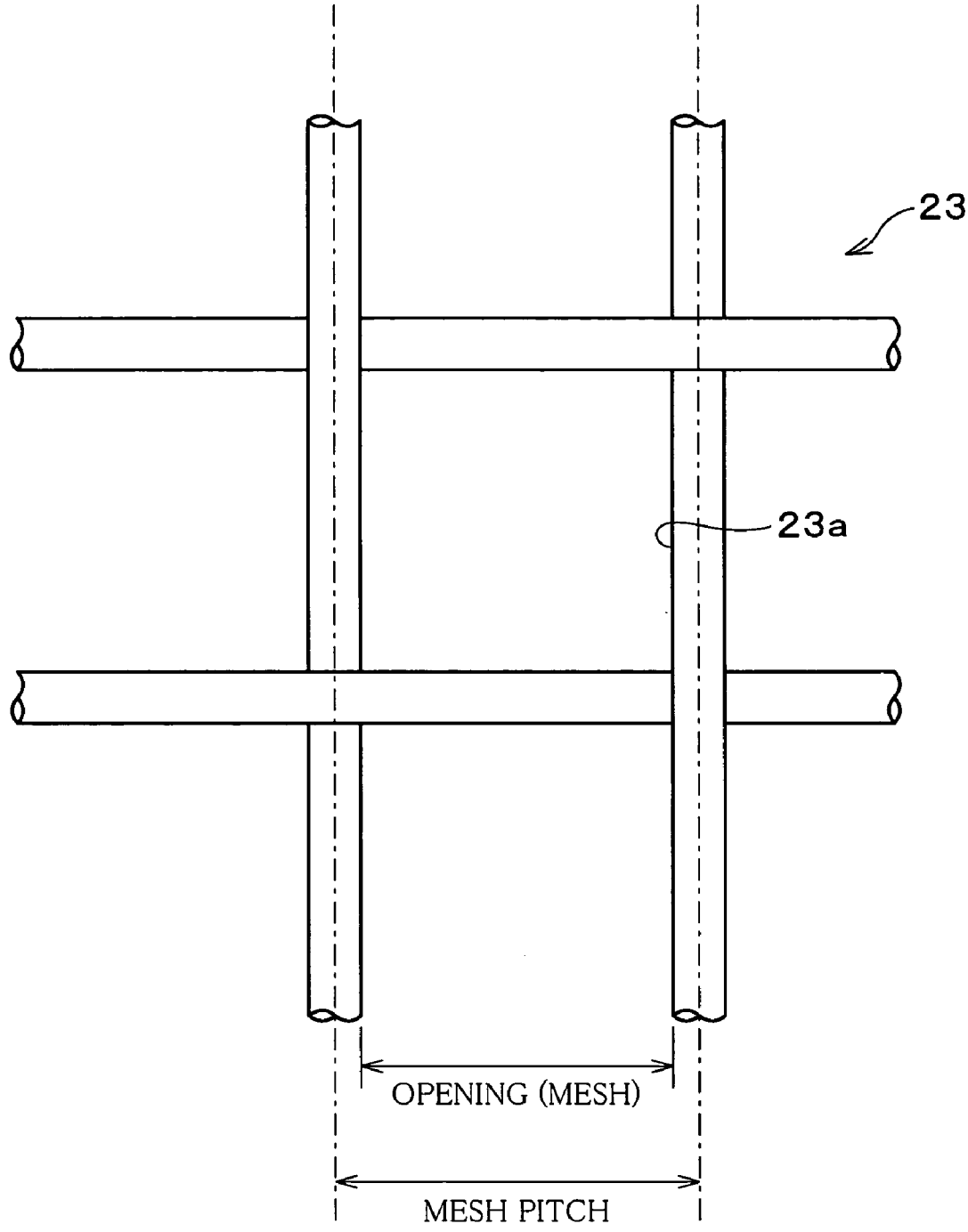
FIG. 5 is a front view illustrating a filter of the ink supply apparatus.

With reference to FIGS. 3 to 5, the ink supplying unit 10 of the ink jet recording apparatus is described below in detail.

As shown in FIG. 3, the ink supplying unit 10 includes the print head 1, the ink cartridge 20, and the ink supplying path 3, as described above.

As shown in FIGS. 4(*a*) and 4(*b*), the ink cartridge 20 generally has an ink tank 21. The ink tank 21, which is provided as an ink containing section inside the ink cartridge 20, is for storing ink therein. In the ink cartridge 20 of the present embodiment, the ink tank 21 includes an ink absorbing body 22, which is, for example, a porous material made of polyurethane resin for retaining ink.

The ink tank 21 has, along a bottom surface thereof for example, the ink supplying path 3 realized by an ink supplying tube 4 for supplying ink to the print head 1.

In the ink supplying path 3, a filter 23 is provided. Specifically the filter 23 is located in that part of the ink supplying path 3 which is near the ink tank 21. Preferably, the filter 23 is located at that end of the ink supplying path 3 which is associated with the ink tank 21. The ink supplying tube 4 is connected with the ink tank 21 by inserting, into the ink tank 21 (for example, into an ink supplying outlet 24 of the ink tank 21), that end (ink supplying outlet 3*a*) of the ink supplying path 3 (that is, the ink supplying tube 4) at which the filter 23 is provided. With this arrangement, that end (ink supplying outlet 3*a*) of the ink supplying path 3 (that is, the ink supplying tube 4) at which the filter 23 is provided, is located inside the ink tank 21.

Moreover, as shown in FIGS. 4(*a*) to 4(*c*), that part of the ink supplying tube 4 which is outside of the ink tank 21 is provided with a pair of detecting electrodes (electrode section) 25, which function as ink remaining amount detecting electrodes (detectors). The detecting electrodes 25 are so located as to sandwich the ink supplying tube 4 therebetween. That is, the ink supplying path 3 is provided with the pair of detecting electrodes 25 located outside of the ink tank 21 and sandwiching the ink supplying path 3.

By applying negative pressure via the filter 23 from a print head 1 side so as to suck out the ink, the ink supplying unit 10 supplies, to the print head 1, the ink stored (contained) in the ink tank 21.

The print head 1 is adapted to eject, for example, 0.49 cc ($0.49\times10^{-6}$ $m^3$) of ink per minute when all channel continuous driving is performed. As the ink is ejected (jetted out, sprayed), the ink is sucked up. The ink thus sucked us as the ink is ejected is in the same amount as the ink thus ejected. The pressure exerted within the ink supplying path 3 can be measured by a pressure gauge 26, as shown in FIG. 3. The print head 1 and the ink cartridge 20 are so positioned that a water head (Ph; head water head pressure) of the print head 1 is 50 mm, and a water head (Pi; tank water head pressure) of the ink tank 21 is 30 mm, for example. Note that the head water head pressure Ph is water head pressure between an spraying nozzle 1*a* of the print head and the ink supplying outlet 24. Moreover, the tank water heed pressure Pi is water head pressure produced when the ink is supplied to the print head 1 via the ink supplying outlet 24 from the ink tank 21 that is full of the ink.

Note that the ink supplying unit 10 of the present embodiment is so arranged that the ink is supplied into the ink supplying path 3 at a rate of 1.0 cc or less (that is ($1.0\times10^{-6}$ $m^3$ or less).

The filter 23 is made of, for example, stainless steel, and is prepared by braiding bands of stainless steel as shown in FIG. 5. However, the filter 23 may be prepared in other ways. For example, the filter 23 may be prepared by reticulating (making many small holes in) a plate by etching.

As shown in FIGS. 4(*a*), 4(*b*), and 4(*c*), in the ink cartridge 20, a remaining amount of ink (depletion of ink) is detected by utilizing the fact that no current flows across the detecting electrodes 25 when ink has been pushed out from between the detecting electrodes 25 by the air entrained into the ink supplying path 3 through the filter 23, that is, when there is no ink between the detecting electrodes 25.

Figure 6:
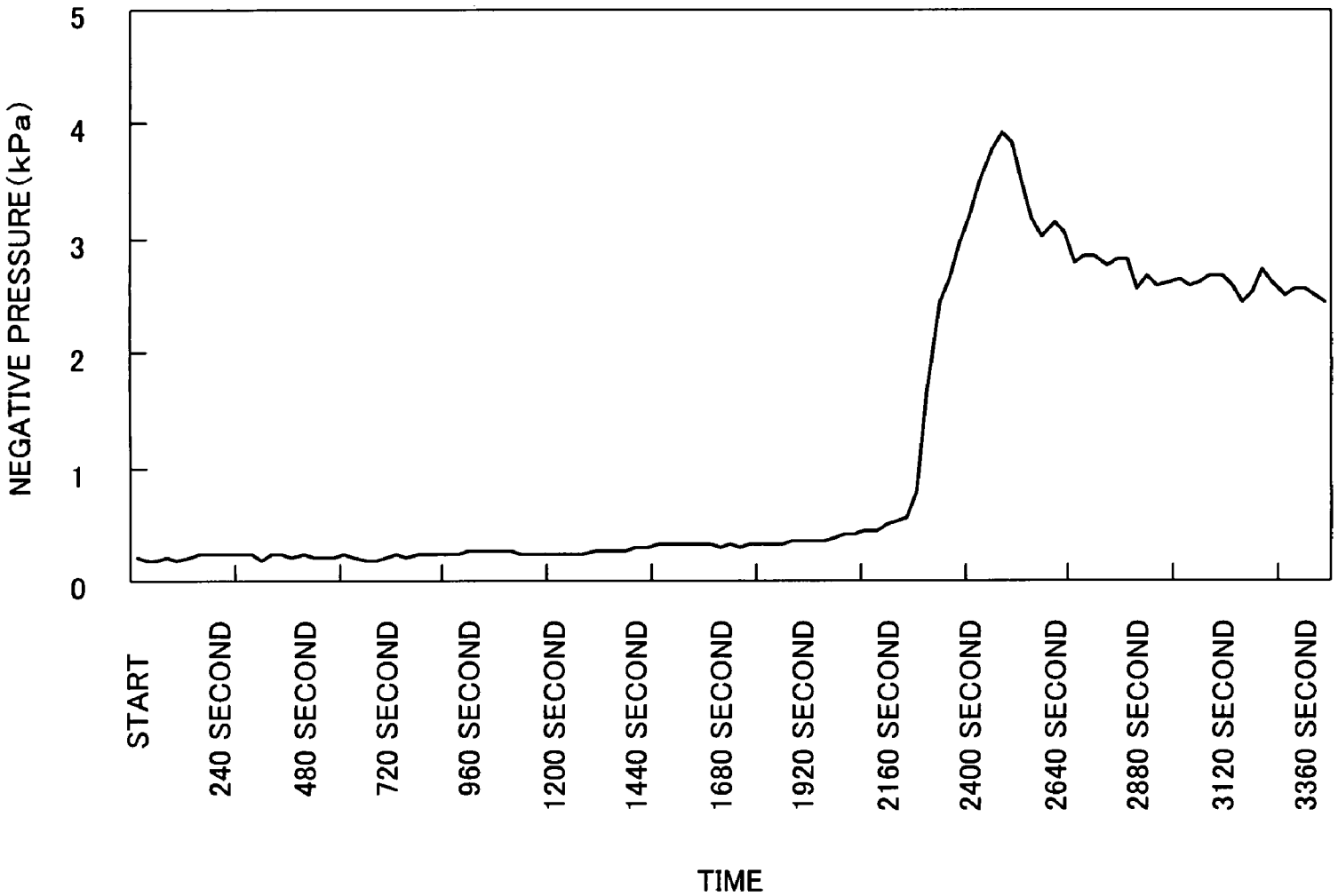
FIG. 6 is a graph illustrating a relationship between time and a negative pressure of the ink cartridge, in a case where the ink is continuously jetted out from the ink cartridge that is full of the ink.
Figure 7:
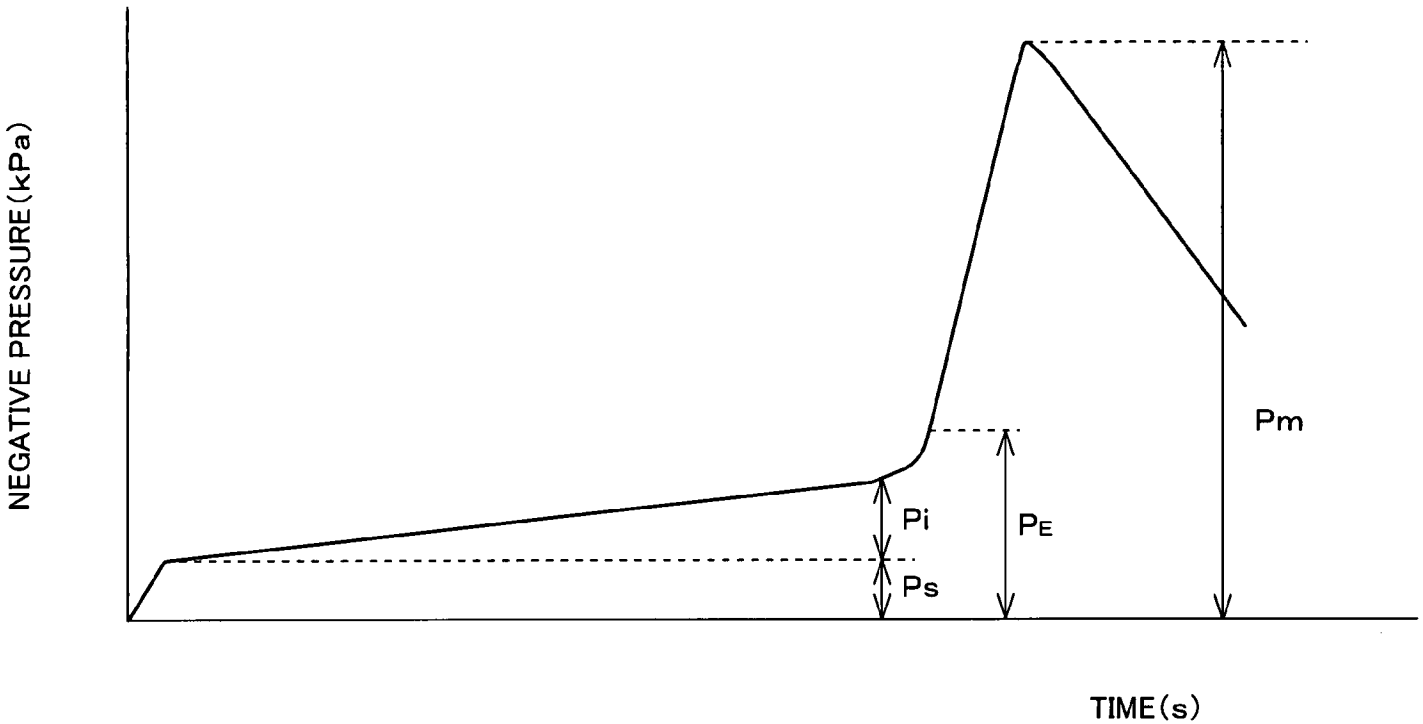
FIG. 7 is a schematic graph of FIG. 6.
Figure 8:
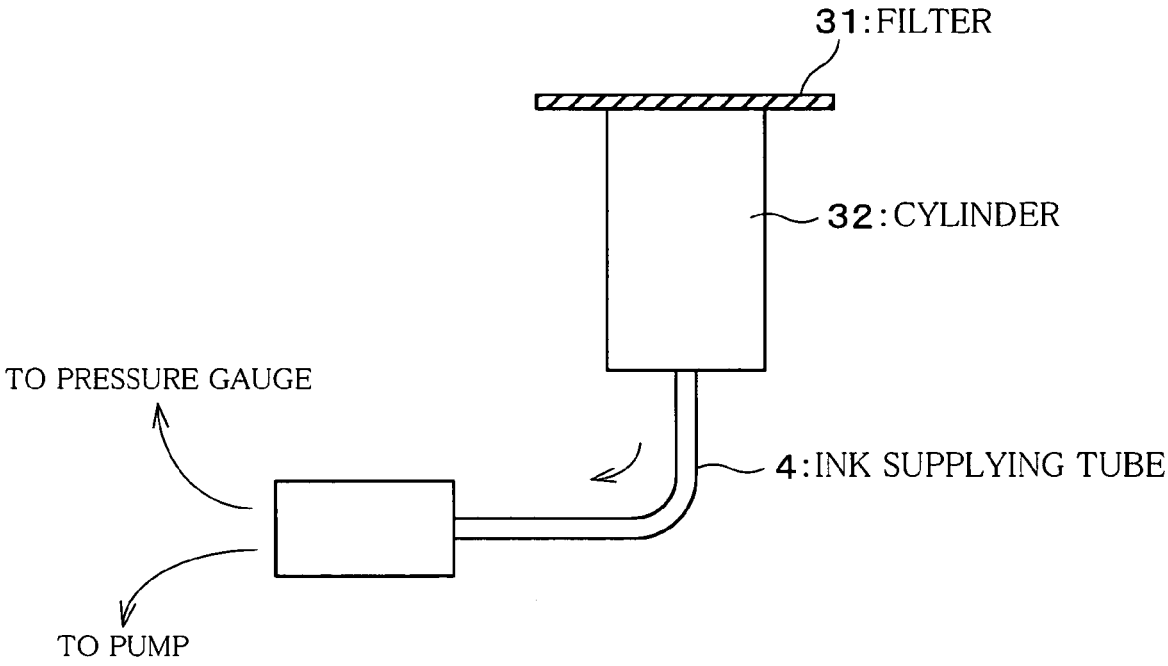
FIG. 8 is a schematic diagram showing an arrangement of a measurement apparatus used for measurement of negative pressure exerted within an ink supplying path of the ink jet recording apparatus.

The following describes a relationship between the negative pressure applied within the ink supplying path 3 and the elapsed time, with reference to FIGS. 6 to 8. FIGS. 6 and 7 are graphs showing a relationship between applied pressure within the ink supplying path 3 and elapsed time of continuous ejection of ink where the ink cartridge 20 is full of ink at a start of the ejection of ink. FIG. 7 is a graph schematically showing the relationship shown in FIG. 6.

First, when the print head 1 is driven, that is, when a negative pressure is created in the ink supplying path 3 to consume the ink inside the ink tank 21 (that is, to supply the ink out to the ink tank 21 thereby reducing the ink in the ink tank 21), the negative pressure gradually increases as the amount of ink consumed increases, as shown in FIGS. 6 and 7.

When the remaining amount of ink becomes low, the negative pressure increases abruptly at a certain moment. After reaching its maximum value, the negative pressure is reduced. This can be explained as follows. When a large sucking force is exerted on the ink supplying tube 3, a film (meniscus) of ink in the meshes (cells) of the filter 23 is broken. The breakage of the ink film causes sucking-in of the air, thereby setting off an abrupt increase in negative pressure.

That is, the increase in negative pressure is caused by the following sequence of events. As the remaining amount of the ink is decreased, the meniscus of ink absorbed in the cell 22*a* (opening section, see FIG. 13 and the like Figure.) is moved back (retreated). As a result, surface tension of the ink causes gradual increase in the negative pressure exerted in the ink supplying path 3. The meniscus of the ink (ink meniscus) reaches the filter 23 when the negative pressure exerted in the ink supplying path 3 exceeds a critical pressure due to the cell 22*a* of the ink absorbing body 22, that is, a critical pressure PE which the ink absorbing body 22 has when the ink tank 21 is empty of the ink. As a result, the negative pressure exerted in the ink supplying path 3 is dominated by an opening section 23*a* of the filter 23. Then, as the ink is further consumed, the ink meniscus is moved further back from the opening section 23*a* of the filter 23, as the meniscus has been moved back in and from the ink absorbing body 22. Because of the surface tension of the ink, the negative pressure exerted in the ink supplying path 3 is increased, and then suddenly jumped up to a critical pressure (filter pressure) of a diameter of the opening of the opening section 23*a*, that is, a critical pressure (maximum negative pressure) Pm of the filter 23. When the suction pressure from the print head 1 exceeds the critical pressure, the surface of the ink meniscus formed in the meshes of the filter 23 is broken, with the result that the air is sucked into the ink supplying path 3. Thereby, the negative pressure is decreased.

Note that the negative pressure within the ink supplying path 3 was measured by using a measurement apparatus as shown in FIG. 8. The measurement apparatus is provided with a filter (mesh filter) 31, a cylinder 32, and an ink supplying tube 4. The filter 31 has a mesh-like shape, and soaked with the ink as the filter 23 is when the detection of the ink remaining amount is performed. The filter 31 is so attached on the cylinder 32 as to cover one end of the cylinder 32. The ink supplying tube 4 is connected with the cylinder 32.

Via the ink supplying tube 4 connected to the cylinder 32, the ink soaked in the filter 31 was so sucked, by a pump (not shown), that the ink flows, through an ink supplying path 3 constituted by the ink supplying tube 4, at a rate of 0.05 cc (that is, $0.05\times10^{-6}$ $m^3$) per minute (the ink supplying amount was 0.05 cc (that is, $0.05\times10^{-6}$ $m^3$) per minute). A negative pressure exerted on the filter 31 when the ink was soaked as such was measured. In this manner, the negative pressure exerted within in the ink supplying path 3 constituted by the ink supplying tube 4.

Figure 9:
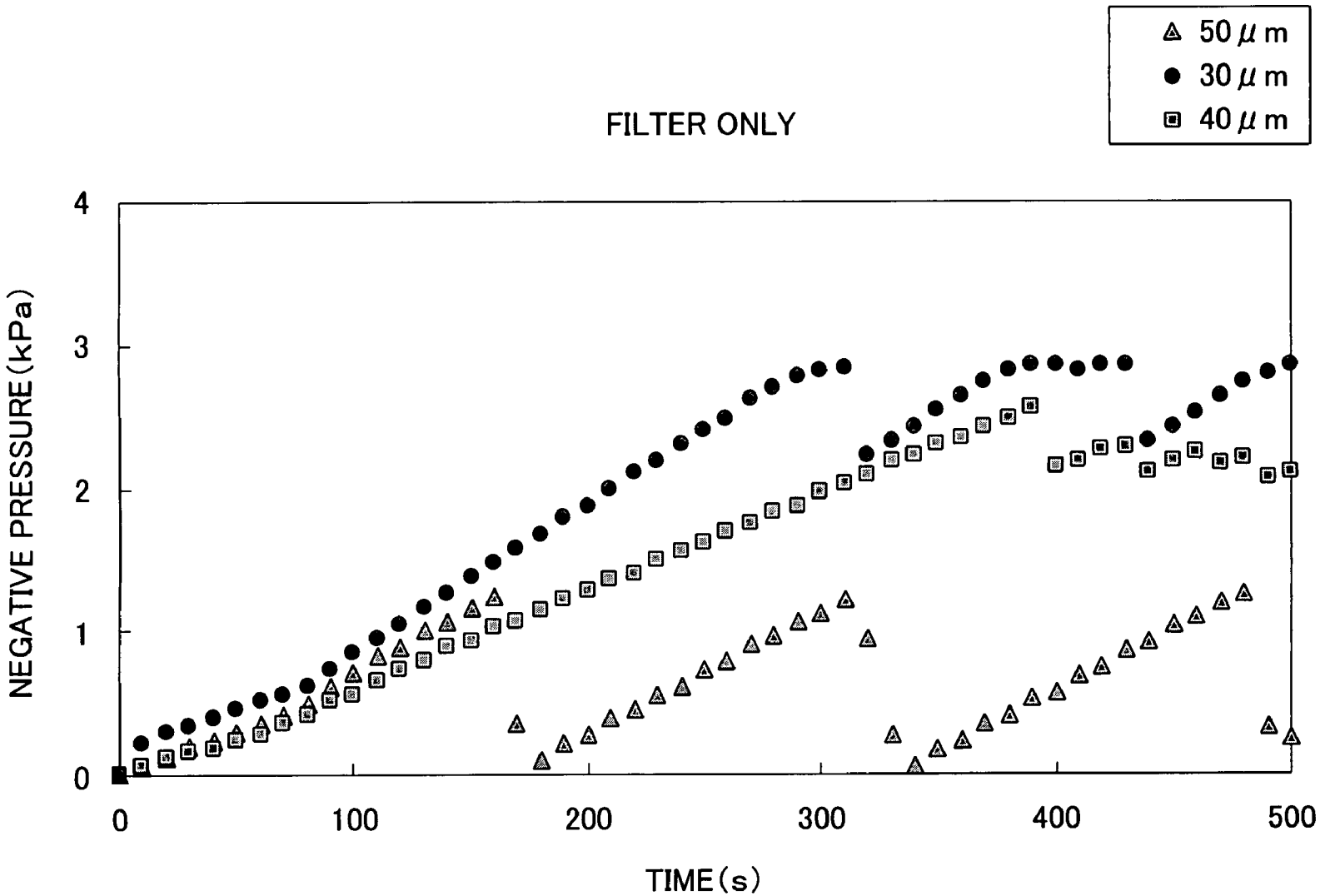
FIG. 9 is graph showing a relationship between filtration accuracy of a filter actually used in the measurement carried out by using the measurement apparatus shown in FIG. 8, and the negative pressure exerted within the ink supplying path.

Moreover, the measurement values of the negative pressure was also carried with filters 23 having opening sections 23*a* (mesh) of different sizes (filtration accuracy F), that is, with filters 31 having opening sections of different sizes. As shown in FIG. 9, it was found that there was a tendency that a smaller filtration accuracy F caused exertion of a higher negative pressure within the ink supplying path 3, that is, exertion of a higher negative pressure on the filter 23 (the filter 31 in the measurement).

Therefore, this tendency was studied next, by making a graph (FIG. 10) of the relationship between (a) the critical pressure (maximum negative pressure) Pm of the ink negative pressure of the filter 23 (mesh filter), and (b) the filtration accuracy F of the filter 23.

Here, it can be interpreted that the filtration accuracy F is a dimension of a shortest length (dimension of the shortest gap width ) of the opening section 23*a* of the filer 23 (mesh filter).

It is widely known that the following Equation (1) gives a critical pressure (critical pressure due to the surface tension) Pc (Pa) at a circular opening section (opening) having a diameter d (m) with respect to a liquid having a surface tension η (N/m) and forming an ink meniscus at the circular opening section. The Equation (1) is:

$$Pc=4\eta/d \quad (1).$$

Note that the same symbols in the equations, experimental formulas, relational expressions and the like in the present embodiment indicate the same property.

The critical pressure Pm (Pa) of the filter 23 was obtained, as the critical pressure Pc (Pa), by substituting, in Equation (1), the diameter d (m) with the filtration accuracy F (m) of the filter 23. It wad found that the equation (1) thus substituted gave calculated values larger than actual measurement values by a multiple of $\sqrt{2}$ (by a factor of $\sqrt{2}$). Thus, the substitution of the diameter d(m) with the filtration accuracy F of the filter 23 caused a large difference between the calculated values (given by from the Equation (1) thus substituted) and the actual measurement values (measurement values obtained by actually measuring the critical pressure Pm as described above).

It was considered that such difference was caused because the shape of the opening sections 23*a* of the filter 23 (which is constituted of horizontal and vertical strings as shown in FIG. 5) is not circular (round) so that the filtration accuracy F is dependent on the dimension of the shortest gap width of the opening section 23*a* of the filter 23 while the critical pressure Pm of the filter 23 is dependent on a dimension of a largest gap width of the opening section 23*a* of the filter 23.

Based on this, the critical pressure Pm (Pa) of the filter 23 is expressed as the following Experimental Equation (2), using the surface tension n(N/m) of the ink and the filtration accuracy F(m):

$$Pm=4n/(\sqrt{2}\cdot F) \quad (2).$$

Figure 10:
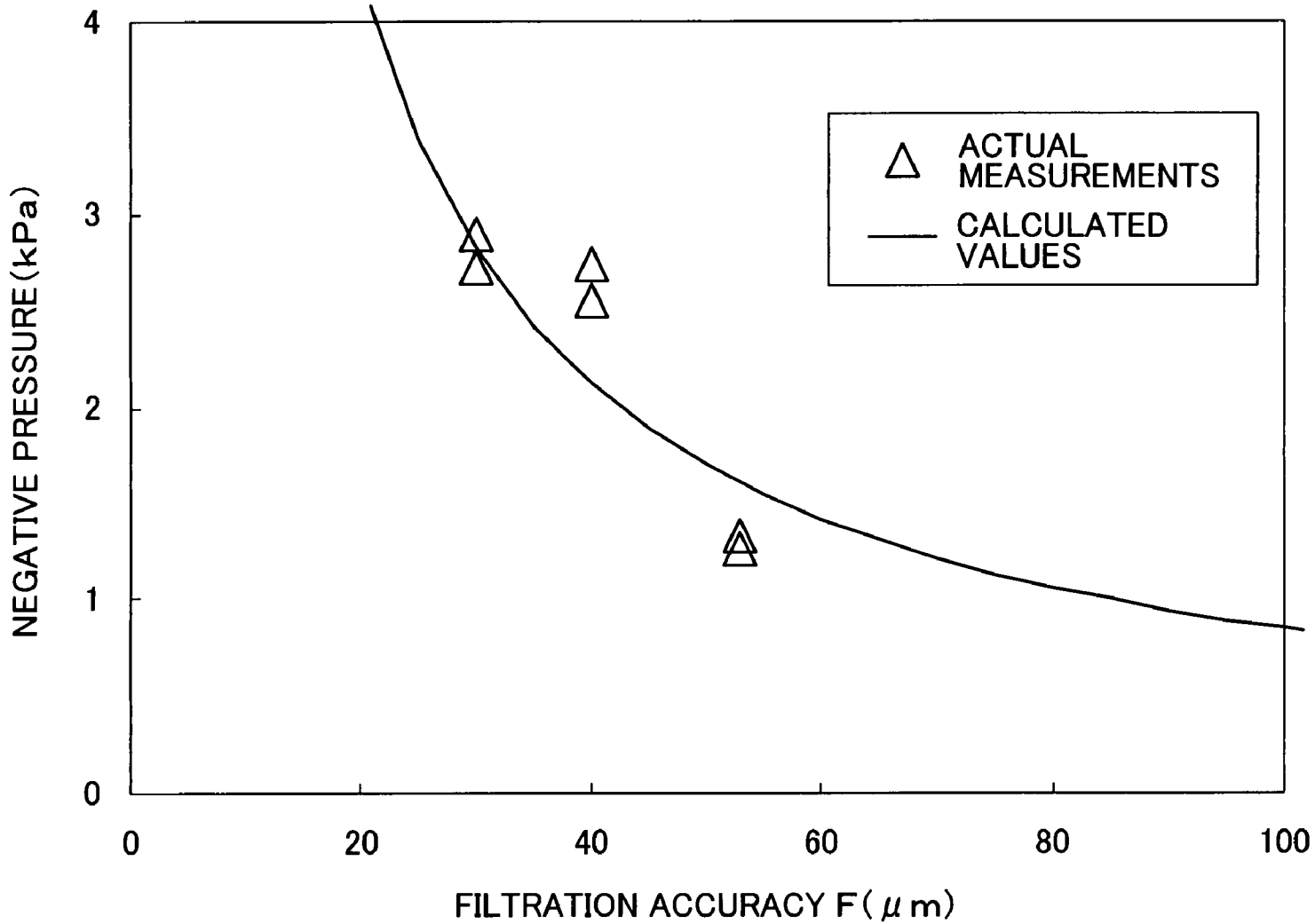
FIG. 10 is a graph showing a relationship between the filtration accuracy of the filter and a critical pressure of the ink negative pressure due to the filter.

FIG. 10 is a graph showing the relationship between the critical pressure Pm of the filter 23 and the filtration accuracy F, the relationship being obtained from the measurement value shown in FIG. 9 and the calculated value obtained from Experimental Equation (2). In FIG. 10, the vertical axis is the critical pressure Pm of the filter 23, that is, the negative pressure exerted with in the ink supplying path 3, whereas the horizontal axis is the filtration accuracy F of the filter 23. Further in FIG. 10, "Δ" is the measurement value and the solid line is the calculated value obtained from Equation (2).

The result shown in FIG. 10 explains that the measurement values actually measured substantially matched with the calculated values calculated from Experimental Equation (2), thereby proving that the tendency described above is correct. That is, from the results shown in FIGS. 9 and 10, it was found that the critical pressure Pm due to the filter 23 is dependent on the size of the opening section 23*a* of the filter 23.

Therefore, in the present embodiment, it is so controlled that the critical pressure Pm due to the filter 23, at which the ink meniscus is broken, will not exceed a predetermined value, by setting such that a time when the ink tank 21 is substantially empty, that is, a time when ink remaining amount is depleted, is a time when the detection resistance value detected by using the detecting electrodes 25 reaches and exceeds a predetermined value as a result of the presence of the air in the electrode section composed of the detecting electrodes 25, the air reaching the electrode section when the meniscus (ink liquid surface) of the ink formed in the opening section of the filter 23 is broken (ruptured) when the negative pressure exerted within the ink supplying path 3 reaches the critical pressure Pm, as shown in FIG. 7.

The present embodiment is so arranged that the negative pressure exerted within an ink supplying system (critical pressure of the filter 23 or the ink absorbing body 22) is set at 2.0 kPa or less, as a result of a number of experiments on the negative pressure exerted within the ink supplying path 3 when the ink remaining amount is depleted.

Figure 21:
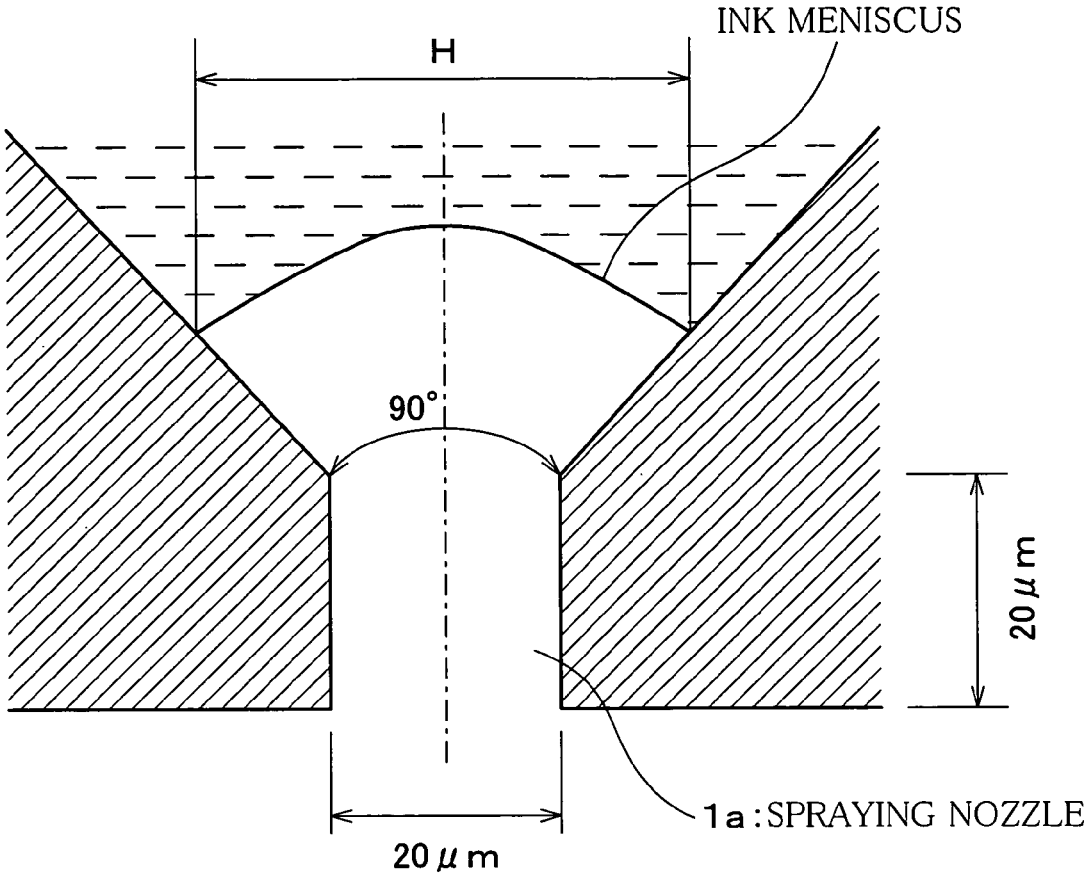
FIG. 21 is an enlarged cross sectional view showing an end of the supply outlet.
Figure 22:
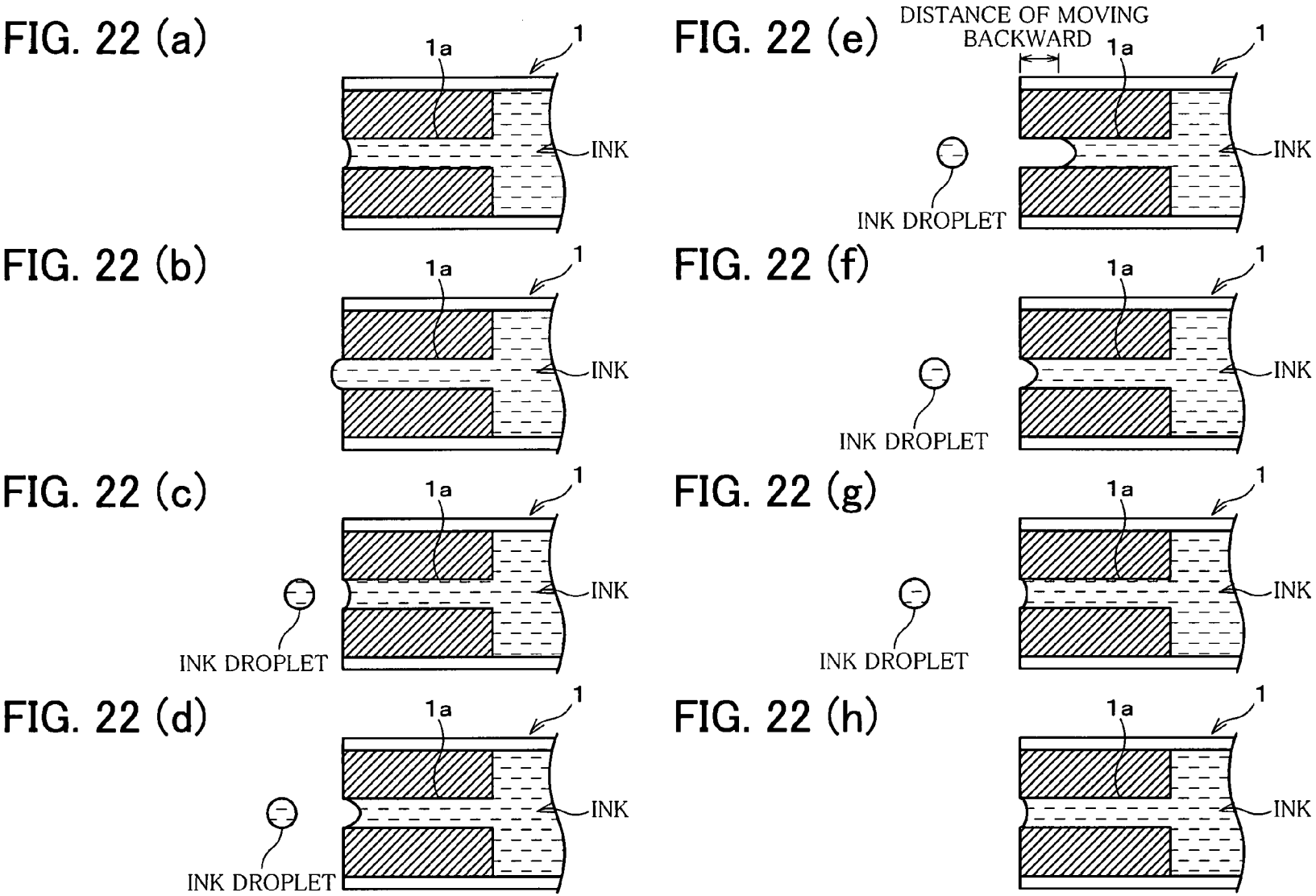
FIGS. 22(*a*) to 22(*h*) are cross sectional view illustrating how the ink is sprayed out of the nozzle.

If the negative pressure exerted within an ink supplying system (critical pressure of the filter 23 or the ink absorbing body 22) is set above 2.0 kPa, there would be such problem, for example, in performing continuous ejection of the ink, that the ink meniscus (ink liquid surface) is moved back too much from the end section (nozzle end) of the spraying nozzle 1*a* of the print head 1 (as shown in FIGS. 21 and 22) so that the air is sucked in, before the negative pressure caused in the ink supplying system breaks the ink meniscus formed at the opening section of the filter 23 so that the air is allowed to reach the electrode section. This does not allow normal and stable ejection (supply) of the ink droplets.

Next, described below in detail is how to optimize the ink absorbing body 22 of the ink cartridge 20.

As shown in FIGS. 4(*a*), 4(*b*), and 4(*c*), in the present embodiment, provided is the ink cartridge 20 including the ink tank 21 in which a foam material is contained as the ink absorbing body 22. The porous material of the foam material is soaked with ink. The foam material is contained in a compressed state in the ink tank 21.

The ink retained in the porous material is supplied by a capillary action from inside the ink cartridge 20 to the print head 1 via the ink supplying outlet 24 (nozzle) of the ink cartridge 20.

Incidentally, depending of the ink retaining power of the porous material, there are cases where ink is depleted during the continuous ejection of the ink, or ink leakage is caused when the ink cartridge 20 is inserted (attached) or detached.

These problems can be solved by determining design indices for the ink absorbing body 22 in accordance with properties of the ink. In the present embodiment, an experiment was conducted using ink, the foam material, and the ink cartridge 20 to measure an stable negative pressure P in the ink cartridge 20 and to evaluate design indices. Table 1 shows the result of experiment. The ink, the foam material, and the ink cartridge 20 were used under the following conditions.

Surface tension of the ink: $\eta$=0.03 (N/m) (30 dyn/cm)

Viscosity of the ink: $\mu$=0.07 (Pa·s) (7 cp)

Composition of the ink:

$H_2O$, pigment, and polyethyleneglycol

Cell density of the foam material:

N=40 (cells/inch)=$1.57\times10^3$ (cells/mm);

Material of the foam material: polyurethane;

Inner dimensions of the ink cartridge (width W×depth D×height L):

$$W\times D\times L=0.015\times0.074\times0.030 \text{ (m)}.$$

Outer dimensions of the foam material when contained in the ink cartridge 20 (ink tank 21) is equal to the inner dements of the ink cartridge.

The evaluated properties shown in Table 1 are as follows.

Compressibility R: The volume ratio of the ink absorbing body 22 (foam material) after it is contained in a compressed state in the ink containing section to the ink absorbing body 22 before it is contained in the ink containing section Cell density N (cells/inch): The cell density of the ink absorbing body 22 (foam material) before the foam material is contained in the ink cartridge 20

Actual cell density M of the ink absorbing body 22 (foam material) in a compressed state (cells/inch): The actual cell density of ink absorbing body 22 (foam material) contained in a compressed state in the ink cartridge 20

Flaw rate Q (m3/s): The flow rate of the ink

Efficiency (%): a net amount of flow from the ink cartridge 20 (volume of the ink that can be consumed actually)÷an amount of ink filled (volume of the ink filled);

Maximum ink stable negative pressure Pu (Pa):

The stable negative pressure when the ink cartridge 20 is fully charged with the ink (i.e. when the ink cartridge 20 is full and when the ink is ejected at a certain flow rate.)

Minimum ink stable negative pressure PL (Pa):

The stable negative pressure in the ink cartridge 20 measured when the ink cartridge 20 is charged at the minimum level (i.e. immediately before the ink in the ink cartridge 20 is depleted and when the ink is ejected at a certain flow rate).

TABLE 1

| CR | ACD | FR | Eff | SNP Max. Pu | SNP Min. PL | Ratio at start | | | Ratio at end | | |
|---|---|---|---|---|---|---|---|---|---|---|---|
| R | M(N × R) | Q(nm³/S) | η (%) | (kPa) | (kPa) | Rs | R2 | Rs/R2 | Re | R1 | Re/R1 |
| 2 | 3,150 | 8.17 | 77 | 0.07 | 0.46 | 0.11 | 0.13 | 0.85 | 0.46 | 0.36 | 1.28 |
| 5 | 7,874 | 8.17 | 60 | 0.62 | 0.86 | 1.00 | 0.83 | 1.21 | 0.87 | 0.91 | 0.96 |
| 5.5 | 8,661 | 8.17 | 60 | 0.62 | 0.99 | 1.00 | 1.00 | 1.00 | 1.00 | 1.00 | 1.00 |
| 6 | 9,449 | 8.17 | 61 | 0.73 | 1.16 | 1.18 | 1.19 | 0.99 | 1.17 | 1.09 | 1.07 |
| 7 | 11,024 | 8.17 | 60 | 0.91 | 1.29 | 1.47 | 1.62 | 0.91 | 1.30 | 1.27 | 1.02 |
| 8 | 12,598 | 8.17 | 51 | 1.30 | 1.50 | 2.10 | 2.12 | 0.99 | 1.52 | 1.45 | 1.04 |

Abbreviation
CR: Compression Rate
ACD: Actual Cell Density
FR: Flow Rate Actually Measured
Eff.: Efficiency
SNP: Stable negative pressure actually measured
Max.: Maximum
Min. Minimum Note that, in consideration of foreign material removing capacity of the filter 23, the present embodiment is so set that Pm>PE, where PE is the critical pressure PE of the ink absorbing body 22 when the ink is depleted (hereinafter, PE may be referred to as critical pressure of the ink absorbing body) and Pm is critical pressure Pm due to the filter 23. Further, the present embodiment is so as that, as shown in FIG. 7, Pm>PE>Pμ+Pi, where PE and Pm are the critical pressures mentioned above, Pμ is pressure loss of the ink supplying path 3, and Pi is the tank water head pressure. However, it should be noted that the present embodiment is not limited to those setting, and may be so set that the above magnitude relationship is opposite, depending on how the ink supplying system is arranged, and may be so arranged that no filter 23 is provided.

Moreover, as later described in detail, intensive fluid dynamical study on the measurement value of the generated negative pressure revealed that the maximum ink stable negative pressure Pu is due to the pressure loss in the path in which the ink flows, that is, the ink supplying path 3, while the minimum ink stable negative pressure PL is based on the surface tension η of the ink.

Note that the experiment should be conducted with ink retaining power of the ink determined in consideration of a height of the ink cartridge 20, variances among the foam cells 22*a* of the ink absorbing body 22 (foam material), and the vibration applied to the ink cartridge 20. This is because poor ink retaining power causes the problem of accidental ink leakage when the ink cartridge 20 is inserted or detached in a fully charged state.

For example, where the height of the ink cartridge 20 is 34 mm, a required ink retaining power is 68 (=34×2) mm by water head (0.67 kPa), assuming a safety factor of 2, because the specific gravity γ of the ink is about 1.0. Moreover, the height of the ink cartridges widely used is generally 40 mm or less. Because of this, the ink cartridges should be tolerant to the water head pressure of the ink of 0.8 Kpa.

Assuming that the ink retaining power is capillary pressure due to the surface tension η and the cell diameter when the ink absorbing body 22 is held in compression is a diameter d(m) of an circular opening section, the cell diameter d(m) when the ink absorbing body 22 is held in compression is expressed as:

$$d=1/(N\cdot R) \quad (3),$$

from that M is the actual cell density of the ink absorbing body 22 (foam material) (M=(N·R); to be exact (M≈(N·R) (cell/m)). Therefore, from Equation (1) and relational Expression (3), the relationship of the critical pressure PE with the cell density N (cell/m) and the compression ratio (R) is:

$$P_E=4\cdot\eta\cdot(N\cdot R) \quad (4),$$

where η is the surface tension of the ink (N/m). By setting the actual cell density M (cells/inch) to be not less than $7.87\times10^3$ (cell/m) (that is, no less than 200 cells/inch), the minimum ink stable negative pressure PL can produce an ink retaining power of no less than 0.86 kPa (89 mm by water head). Accordingly, it is possible to prevent the problem of accidental ink leakage when the ink cartridge 20 is inserted or detached.

When continuous ejection of the ink is performed, the negative pressure generated by the supply system needs to be no larger than approximately 2.0 kPa, considering the safety factor. If not, the negative pressure generated by the supply system causes depletion of the ink. This leads to a problem that air is sucked into the nozzle as the liquid surface of the ink retreats too much from the end (nozzle end) of the spraying nozzle 1*a*. As a result, the ink cannot be supplied stably.

Figure 11:
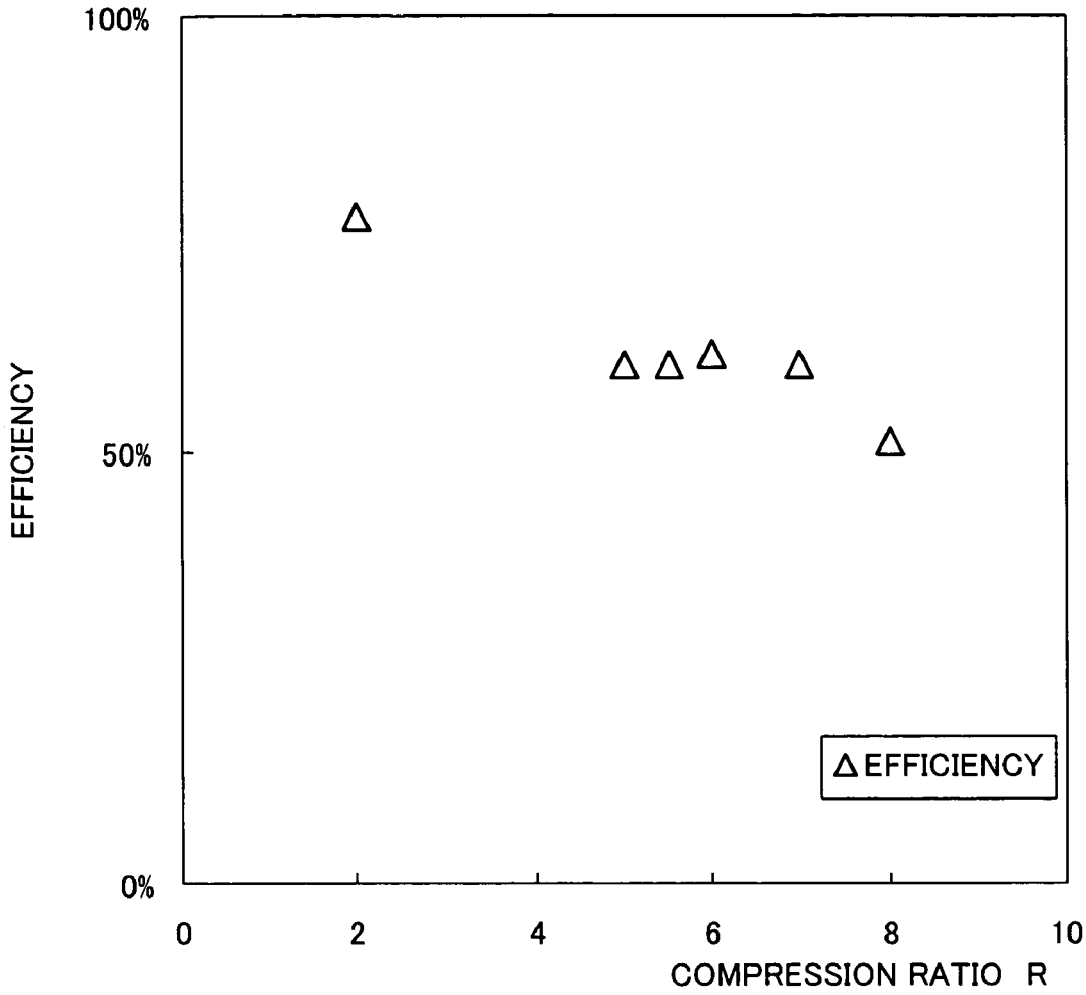
FIG. 11 is a graph showing a cell density and efficiency.
Figure 12:
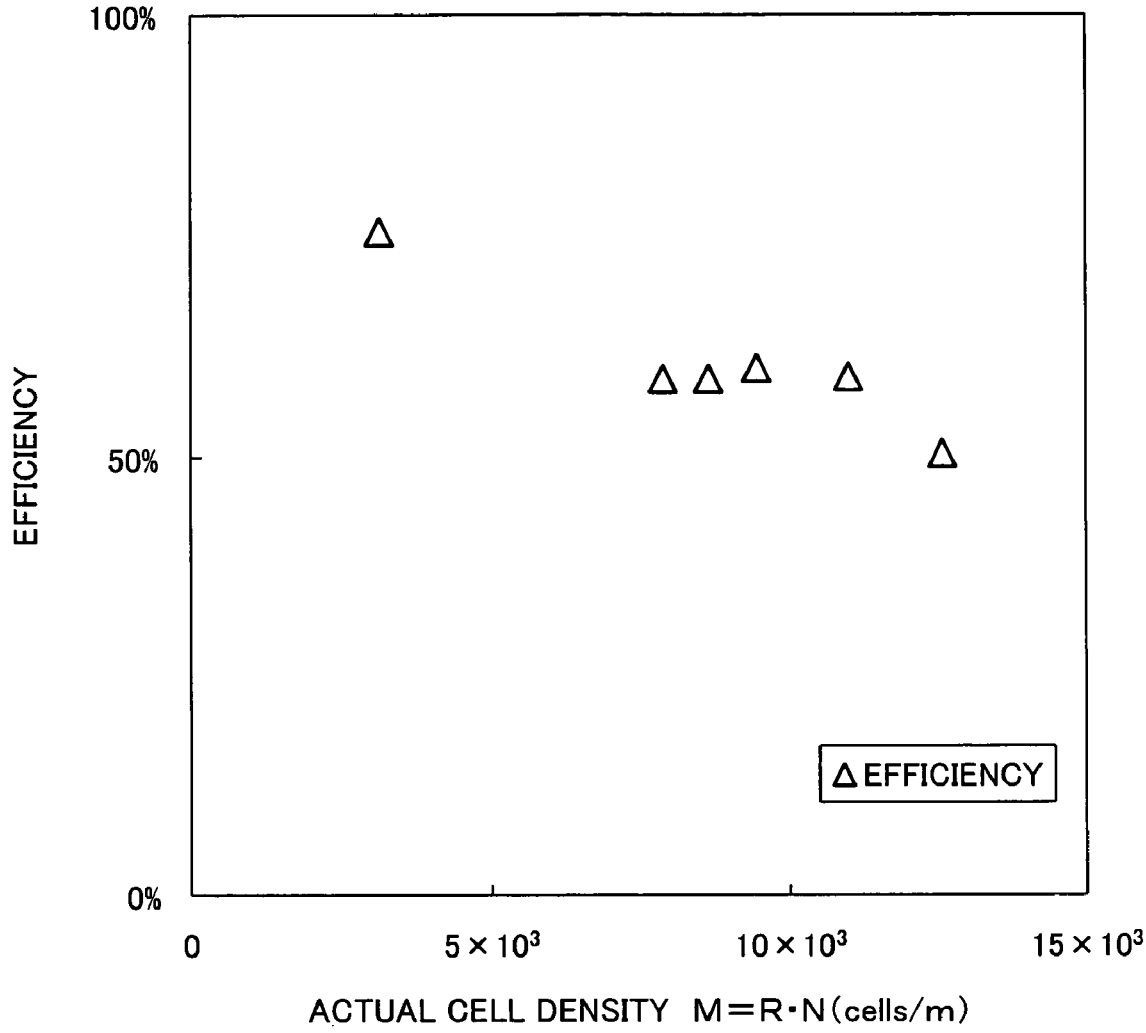
FIG. 12 is a graph showing a relationship between an actual cell density and the efficiency.

By setting the actual cell density M (cells/inch) to be no larger than $12.5\times10^3$ (cell/m) (320 cells/inch or less), the negative pressure generated by the supply system becomes no larger than 1.5 kPa. This makes it possible to stably supply the ink with a margin when continuous ejection of the ink is performed.

Where efficiency T(%) (tank efficiency) is a ratio of the ink volume that can be actually consumed (ejected), with respect to ink capacity ((volume of the ink filled) in the ink cartridge 20, the efficiency T(%) decreases, as shown in FIG. 11, in accordance with the increase of the value of R, in other words, the increase of the value of N·R. As shown in FIG. 12, the efficiency T(%) dramatically decreases when the actual cell density M (M=N·R) reaches $12.6\times10^3$ (cell/m) (that is, 320 cells/inch). Thus, for utilizing a volumetric capacity of the ink cartridge 20 efficiently, the actual cell density (M=N·R) should be $12.6\times10^3$ (cells/m).

Therefore, by arranging the ink cartridge 20 such that the actual cell density M (cells/m) (M=N·R) satisfies $7.87\times10^3 \leqq M \leqq 12.6\times10^3$, it is possible to prevent the problem of accidental leakage of the ink when the ink cartridge 20 is attached or detached. Further, by designing the ink cartridge 20 as such, it is possible to attain stable supply of the ink with a margin, and efficient utilization of the volumetric capacity of the ink cartridge 20. Further, the arrangement allows M to be $7.87\times10^3$ or more and $12.6\times10^3$ or less, thereby allowing to design the ink absorbing body 22 with more freedom.

Even though those values are theoretical values, it was confirmed that the measurement values also satisfied this. That is, the ink minimum stable negative pressure PL, which was measured stable negative pressure, was 0.86 kPa or more when the actual cell density M=N·R was $7.87\times10^3$ (cells/m) in Table 1. Whereas, the negative pressure of the ink supplying system was 1.5 kPa or less when the actual cell density M=N·R was $12.6\times10^3$ (cells/m). Therefore, it is possible to attain stable supply of the ink with a margin even when the negative ejection of the ink is performed. Note that the ink minimum stable negative pressure PL, which was the measured stable negative pressure, was indicative of how much negative pressure the ink meniscus could stand.

Next, the minimum ink stable negative pressure PL and the maximum ink stable negative pressure Pu are discussed. The maximum ink stable negative pressure Pu denotes a negative pressure when the ink is flowing.

First, the values of Rs under "RATIO AT START POINT" in Table 1 are normalized values of the respective maximum ink stable negative pressures Pu with respect to the maximum ink stable negative pressure of Pu=0.62 kPa for the compressibility of R=5.5 and the flow rate of Q=8.17 $nm^3/s$ (0.49 cc/min). R2 represents values of compressibility R2 normalized with respect to the compressibility of R=5.5.

Meanwhile, the values of Re under "RATIO AT END POINT" in Table 1 are values of the respective minimum ink stable negative pressures PL normalized with respect to the minimum ink stable negative pressure of PL=0.99 kPa for the compressibility of R=5.5 and the flow rate Q=8.17 $nm^3/s$ (0.49 cc/min). R1 represents values of compressibility R normalized with respect to the compressibility of R=5.5.

Here, according to Table 1, Rs/R2 calculated at a start point and Re/R1 calculated at an end point are both substantially equal to 1. Therefore, it is found that the maximum ink stable negative pressure Pu is proportional to the square of compressibility R, and the minimum ink stable negative pressure PL is proportional to compressibility R.

Based on these findings and in order to obtain more specific design indices for the ink and the foam material, the following theorization was made and the result was analyzed.

To begin with, the following explains the relationship between the stable negative pressure (ink maximum stable negative pressure Pu) when the ink cartridge 20 is fully charged with the ink, and the compression rate R.

Figure 13:
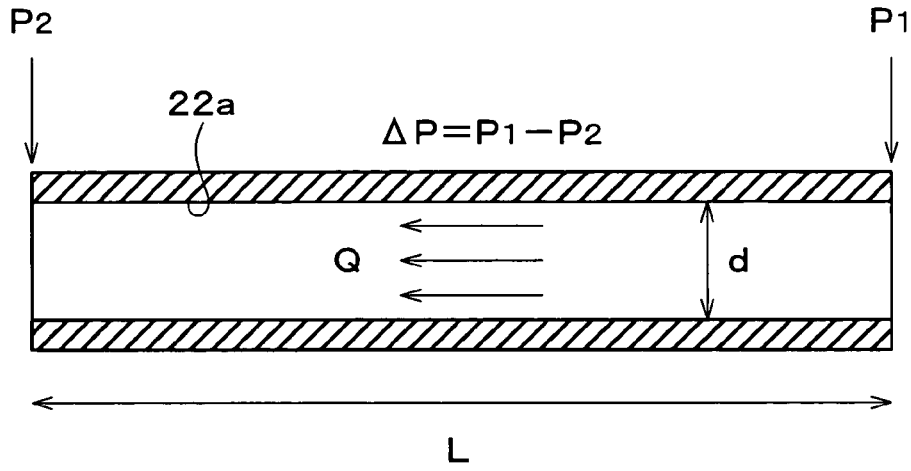
FIG. 13 is a schematic diagram showing a flow rate in a circular tube and a pressure difference of the tube.

When the ink cartridge 20 is fully charged with the ink (i.e. when the ink cartridge 20 is full), it can be assumed that each call 22*a* of the ink absorbing body 22 (foam material) is a round conduit, and that the liquid (ink in the present invention) in the conduit is flown by a pressure difference ΔP (pressure P1 at a starting end of the conduit−pressure P2 at an finishing end of the conduit) within the conduit. That is, it is possible to assume that the liquid (ink) in the pressure loss Pμ in the conduit due to viscous drag. As shown in FIG. 13, a theoretical flow (Q) ($m^3/s$) of a flow in the round conduit (each cell 22*a*), that is, the flow rate Qi ($m^3/s$) of the ink flowing in each round conduit can be defined as:

$$Qi=Pu\cdot\pi\cdot d^4/(128\cdot\mu\cdot L) \quad (5),$$

where Pu is the ink maximum stable negative pressure, which is the pressure loss (Pa) in the conduit due to the viscosity drag of the ink, d is the diameter (m) of the conduit, p is the viscosity (Pa·s) of the ink, and L is the length (m) of the conduit. Since the actual cell density of the ink absorbing body 22 (foam material) in a compressed state is M=N·R (cells/m), the cell diameter d(m) of the ink absorbing body 22 (foam material) in a compressed state is given by:

$$d=1/(N\cdot R) \quad (3)$$

Figure 14:
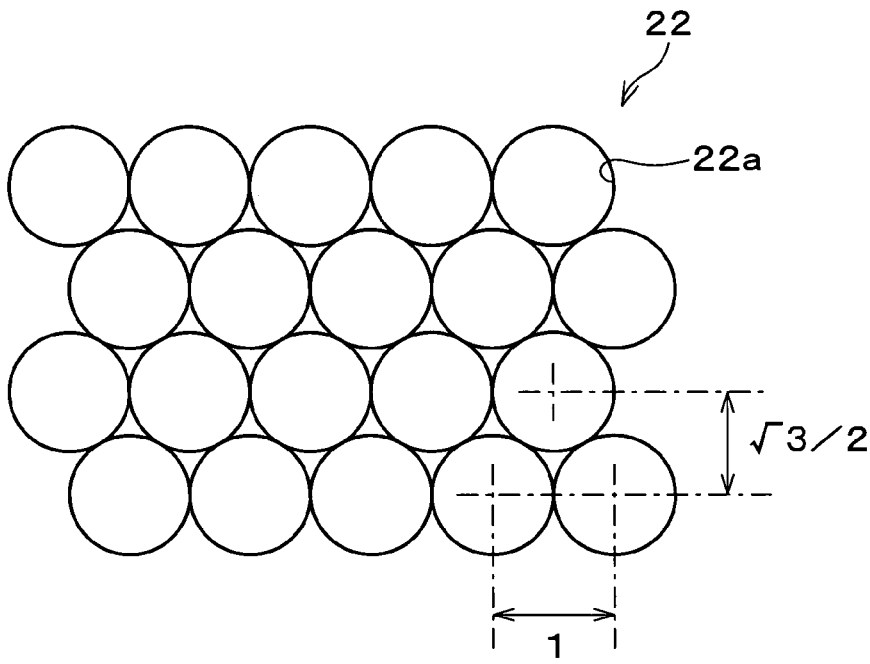
FIG. 14 is a view illustrating an arrangement of cells packed maximally.

Because the ink absorbing body 22 (foam material) is contained in the ink cartridge 20 in the compressed state, the cells 22*a* of the ink absorbing body 22 (foam material) are assumed to be most closely (maximally) packed, as shown in FIG. 14. Therefore, the total number of cells Nd (cells) (cell total number Nd (cells) at a lower end of the foam material in a compressed state is given by:

$$Nd=(2/\sqrt{3})\cdot S/(d^2) \quad (6)$$

where S is the cross-sectional area (width W×depth V) of the ink absorbing body 22 (foam material) contained, under compression, in the ink cartridge 20 (ink tank 21).

It follows from this that, when the flow path is assumed to be a column of a constant diameter in Expression (3), the total flow rate Qt ($m^3/s$) is given as follows according to Equation (3), and Relational Expressions (5), and (6):.

$$Qt=Qi\cdot Nd=\{Pu\cdot\pi\cdot d^4/(128\cdot\mu\cdot L)\}\cdot\{(2/\sqrt{3})\cdot S/(d^2)\}=A\cdot Pu\ S/\{\mu\cdot L\cdot(N\cdot R)^2\} \quad (7)$$

where A is a coefficient of $A=2.83\times10^{-2}$.

It can be seen from this that the total flow rate Qt is inversely proportional to the square of the actual cell density M=N·R (cells/m) of the ink absorbing body 22 (foam material) in a compressed state.

Figure 15:
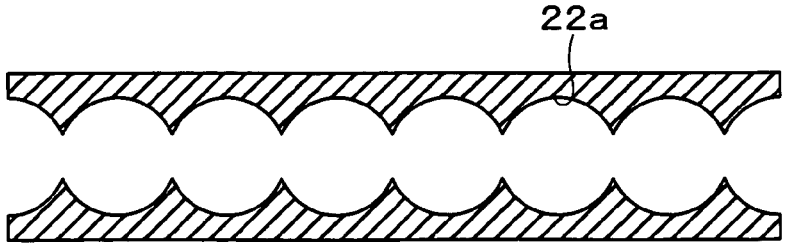
FIG. 15 is a cross sectional view illustrating spherical or polyhedral cells linked together in a beads-like manner in a foam material actually used in the ink cartridge.

Table 2 shows values of the total flow rate Qt, which are theoretical values calculated in accordance with Expression (7), assuming the column-shaped flow path shown in FIG. 15.

TABLE 2

| CR R | Av. CD d (mm) | SNP Max. (Pu) (kPa) | FR/Noz. Qi ($pm^3/s$) | Number of Nozzle Nd (nozzle) | Total FR Qt ($nm^3/s$) | CFR Qc ($nm^3/s$) | Ratio Q/Qc |
|---|---|---|---|---|---|---|---|
| 2 | 0.32 | 0.07 | 8.31 | 11,867 | 99 | 7.18 | 1.14 |
| 5 | 0.13 | 0.62 | 1.89 | 74,169 | 140 | 10.17 | 0.80 |
| 5.5 | 0.12 | 0.62 | 1.29 | 89,744 | 116 | 8.41 | 0.97 |
| 6 | 0.11 | 0.73 | 1.07 | 106,803 | 114 | 8.32 | 0.98 |
| 7 | 0.09 | 0.91 | 0.72 | 145,371 | 105 | 7.62 | 1.07 |
| 8 | 0.08 | 1.30 | 0.60 | 189,872 | 115 | 8.33 | 0.98 |
| | | | | CC | 13.75 | | |

Abbreviation
CR: Compression Rate
Av. CD: Average Cell Diameter
SNP: Stable Negative Pressure Actually Measured
FR/Noz.: Flow Rate per Nozzle
FR: Flow Rate
CFR: Calculated Flow Rate
Max.: Maximum
CC: Correction Coefficient In the actual ink absorbing body 22 (foam material), spherical or polyhedral cells 22*a* are linked together in a beads-like manner, as shown in FIG. 15. The effective diameter is therefore smaller than the theoretical value because of the beads-like flow path. As such, an average multiplication factor with respect to the actual flow rate Q was calculated for the flow rate Qt that was obtained based on the theoretical cell diameter. The resultant value was then used as a correction coefficient k. That is, where Qt/Q≈k, the correction coefficient k is 13.75 in Table 2.

Figure 16:
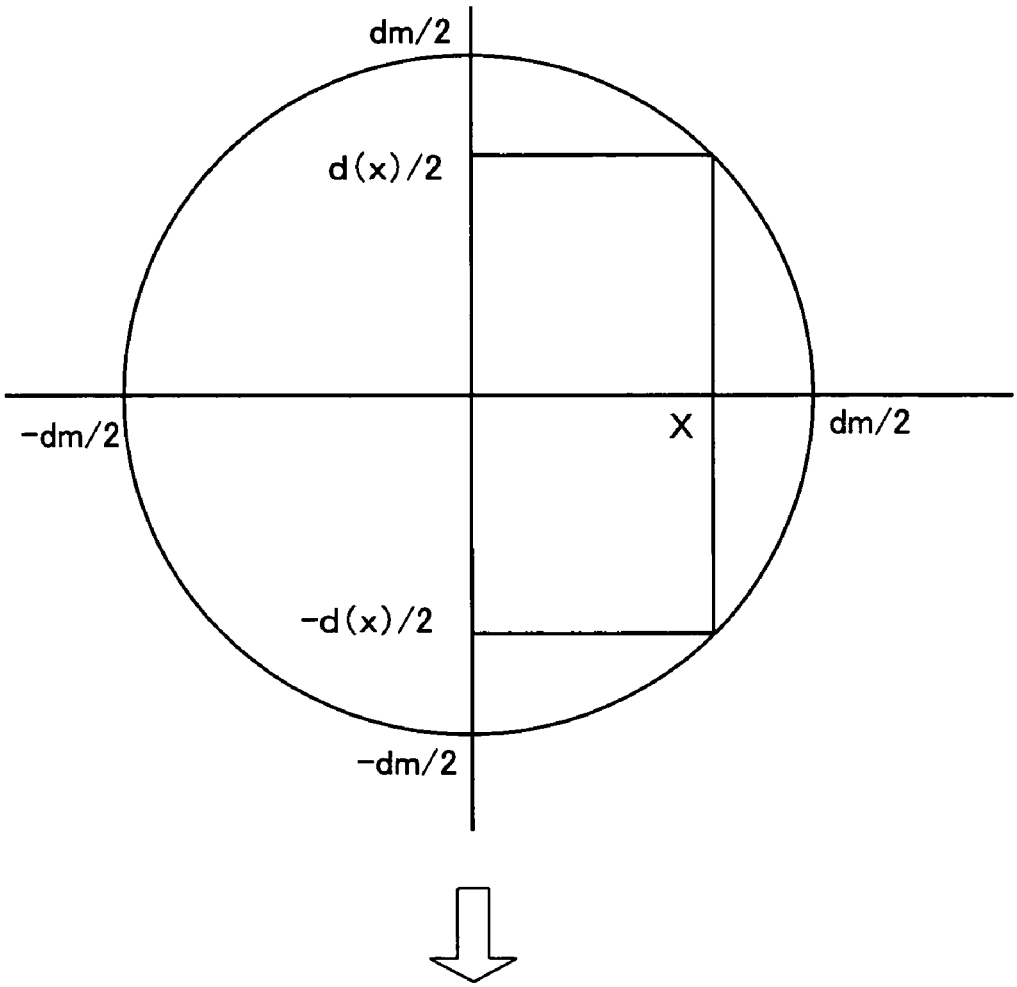
FIG. 16 is an explanatory view showing how to find an actual diameter of the cells linked together in a beads-like manner in the foam material actually used.
Figure 17:
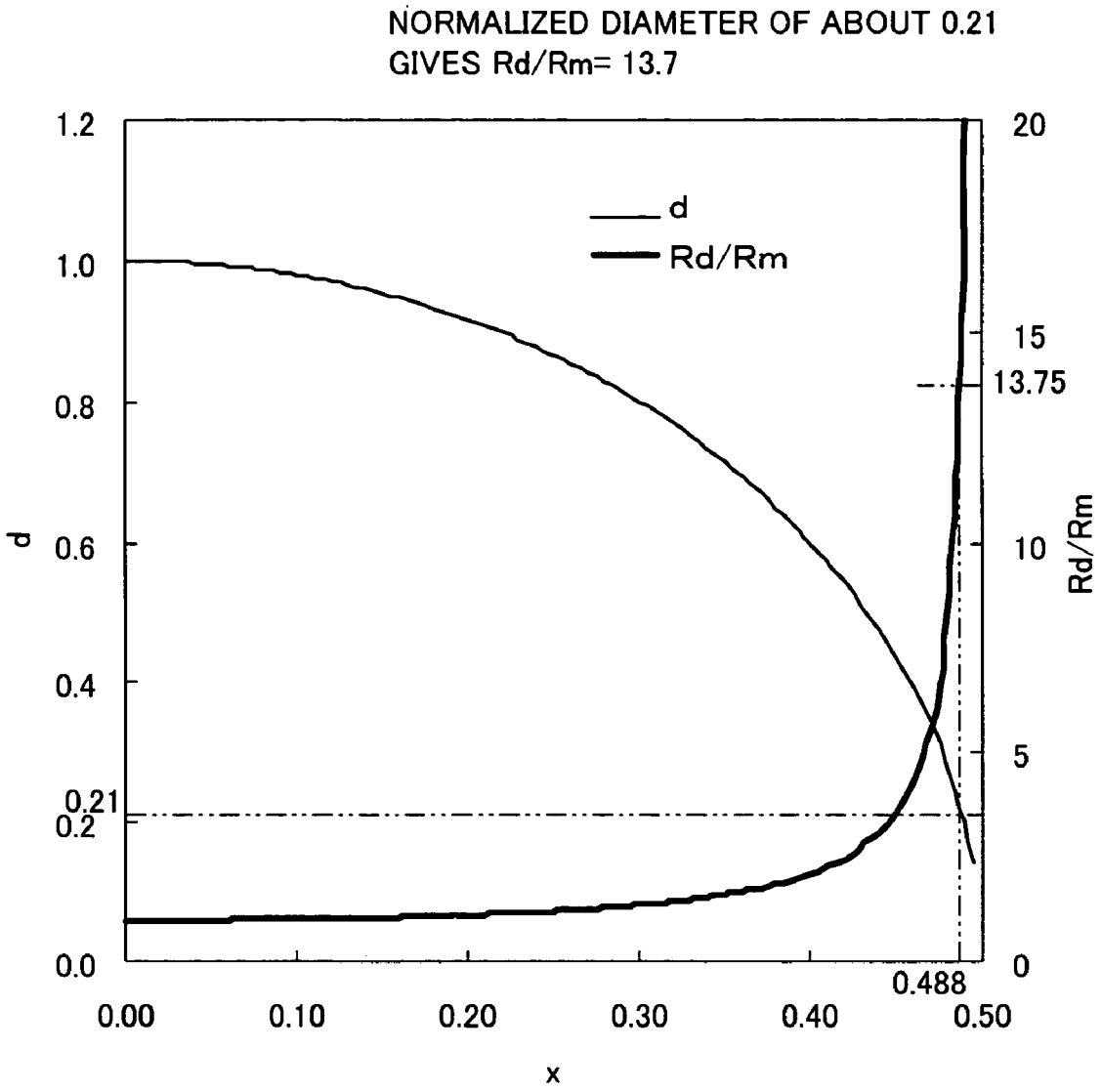
FIG. 17 is a graph showing a relationship between X and resistance ratio Rd/Rm, and a relationship between X and a cell diameter d, where Rd is normalized flow path resistance calculated by performing integration on a spherical flow path with a diameter dm and a center X=0

In the following, observation is made as to the correction coefficient k=13.75, which is obtained by actual measurement. FIG. 17 shows a resistance ratio Rd/Rm, where Rd is the normalized flow path resistance calculated by performing integration on a spherical flow path with a diameter dm and a center X=0 as shown in FIG. 16, and Rm is the normalized flow path resistance in the column-shaped flow path. As shown in FIG. 16, Rd/Rm≈1 when X is in a vicinity of 0, and Rd/Rm increases as X approaches dm/2. Assuming that a normalized cell diameter is 1, Rd/Rm=13.75 at X=0.488. This indicates that it is possible to create a model for the flow path where adjacent cells 22*a* are linked together with a normalized diameter of 0.21. Thus, it is confirmed that the value of the correction coefficient k determined by actual measurement is indeed appropriate.

Using the correction coefficient k, calculated flow rate Qc ($m^3$/S) is defined as the following Relational Expression (8):

$$Qc=Qt/k \quad (8),$$

where k=13.75.

Alternatively, substituting Relational Expression (7) in Equation (8), the following Relational Expression is given:

$$Qc=(A/k)\cdot Pu\cdot S/\{\mu\cdot L\cdot(N\cdot R)^2\} \quad (9)$$

where the coefficient (A/k)=$2.06\times10^{-3}$.

Here, because the respective values of Q/Qc are substantially equal to 1 in Table 2, it can be seen that the flow rate Q can be accurately calculated using the correction coefficient k:

$$Qc=(A/k)\cdot Pu\ S/\{\mu\cdot L\cdot(N\cdot R)^2\},$$

where (A/k) is a coefficient of (A/k)=$1.33\times10^{-6}$. With this equation, it is possible to obtain the flow rate Q accurately.

Moreover, from the flow rate Q actually measured, the theoretical value Pv(Pa) of the pressure loss (pressure difference ΔP) of the conduit due to the viscosity drag is:

$$Pv=(1/A)\cdot\{\mu\cdot L\cdot(N\cdot R)^2/S\}\cdot Q,$$

where the coefficient A=$2.83\times10^{-2}$.

Further, assuming that, as in Relational Expressions (8) and (9), Pμ (calculated pressure difference) is the pressure loss (pressure difference ΔP) in the conduit due to the viscosity drag where the correction coefficient k=13.75, that is, Pμ (calculated pressure difference) is a calculating value of the pressure loss (pressure difference ΔP) in the conduit due to the viscosity drag, Pμ(Pa) is:

$$P\mu=k\cdot Pv=(k/A)\cdot\{\mu\cdot L\cdot(N\cdot R)^2/S\}\cdot Q, \quad (10),$$

where (k/A)=485.

Table 3 shows the theoretical values Pv and the calculated values Pμ of the pressure loss (pressure difference ΔP) in the conduit obtained, from the flow rate Q actually measured, by using Relational Expression (10). Note that the flow rate q is a flow measured per conduit.

TABLE 3

| CR R | ACD M (N × R) | Av. CD d (mm) | FR Q ($nm^3$/s) | Number of Paths Nd (Path) | FR q ($pm^3$/s) | Pressure Pv (kPa) | Pμ (kPa) | Pμ/Pu |
|---|---|---|---|---|---|---|---|---|
| 2 | 3,150 | 0.32 | 8.17 | 11,867 | 0.688 | 0.0058 | 0.08 | 1.14 |
| 5 | 7,874 | 0.13 | 8.17 | 74,169 | 0.1101 | 0.0362 | 0.50 | 0.80 |
| 5.5 | 8,661 | 0.12 | 8.17 | 89,744 | 0.0910 | 0.0438 | 0.60 | 0.97 |
| 6 | 9,449 | 0.11 | 8.17 | 106,803 | 0.0765 | 0.0521 | 0.72 | 0.98 |
| 7 | 11,024 | 0.09 | 8.17 | 145,371 | 0.0562 | 0.0710 | 0.98 | 1.07 |
| 8 | 12,598 | 0.08 | 8.17 | 189,872 | 0.0430 | 0.0927 | 1.27 | 0.98 |
| 9 | 14,173 | 0.07 | 8.17 | 240,307 | 0.0340 | 0.1173 | 1.61 | — |
| 10 | 15,748 | 0.06 | 8.17 | 296,675 | 0.0275 | 0.1449 | 1.99 | — |
| 5.5 | 8,661 | 0.12 | 1.25 | 89,744 | 0.0139 | 0.0067 | 0.09 | — |

ABBREVIATION
ACD: Actual Cell Density
Av. CD: Average Cell Density
FR: Flow Rate Actually Measured Here, Pμ/Pu is substantially 1, where Pμ is the calculated value of the pressure loss (pressure difference ΔP) in the conduit, and Pu is the ink maximum stable negative pressure.

FIG. 17 is a graphical representation of Table 2 and Table 3. As shown in FIG. 17, there is a considerable overlap between the stable negative calculated using the theoretical values (calculated pressure difference Pμ) and the stable negative pressures (ink maximum stable negative pressure Pu) that were actually measured. This shows that the ink maximum stable negative pressure Pu can be accurately calculated using the correction coefficient, because the ink maximum stable negative pressure Pu is created by the pressure loss due to the viscosity of the ink.

Next, discussed below is the relationship between the compression rate R and the stable negative pressure (ink minimum stable negative pressure PL) when the amount of the ink in the ink cartridge 20 is minimum.

When the amount of the ink in the ink cartridge 20 is minimum, (i.e. immediately before the ink in the ink cartridge 20 is depleted), the cells 22*a* at the lower end of the foam material can be regarded as a capillary tube.

Figure 19:
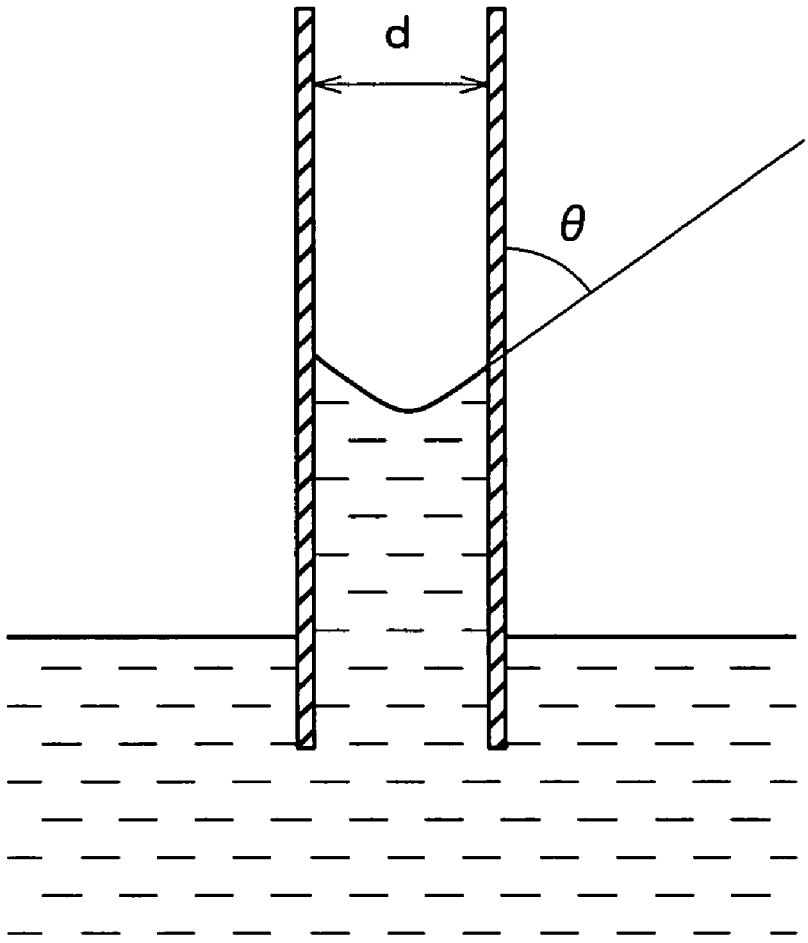
FIG. 19 is a schematic diagram showing a critical pressure of a liquid surface (ink meniscus) in capillary, where the cells of a bottom part of the foam material can be regarded as capillary just before the ink is depleted in the ink cartridge.
Figure 20:
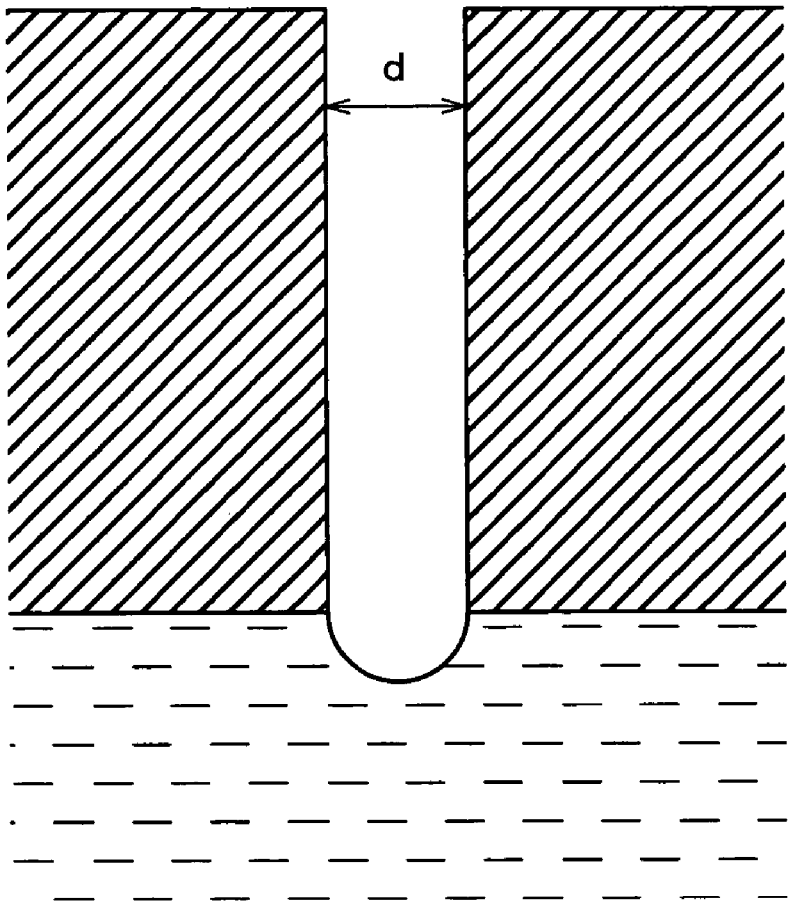
FIG. 20 is a schematic diagram showing a critical pressure of the liquid surface (ink meniscus) in the capillary.

Therefore, as shown in FIG. 19 (when positive pressure is exerted on the liquid) and FIG. 20 (when negative pressure is exerted on the liquid), the critical pressure Pt (Pa) of a liquid surface (meniscus) in the capillary tube (that is, critical pressure $P_E$(=Pt) caused by the ink absorbing body 22 when the ink is depleted) is defined by the following Expression (11):

$$Pt=2\cdot\eta\cdot\cos\theta/(d/2) \quad (11).$$

where η is a surface tension (N/m) of the liquid (ink) in the conduit, θ is a contact angle which is an angle at which the liquid surface (ink meniscus) contacts the conduit, and d is the diameter (m) of the capillary tube. Because such an ink absorbing body 22 is used that has superior wettability to the ink (high affinity for the ink), the contact angle θ can be regarded as substantially equal to zero. Therefore, Expression (11) can be transformed as follows:

$$Pt=4\cdot\eta/d \quad (12),$$

(To say exactly, Pt≈4η/d . . . (12)).

It follows from this that, from Relational Expression (3) and Equation (12), the critical pressure PE (=Pt) due to the ink absorbing body 22 can be expressed as Relational Expression (4) described above:

$$PE=4\cdot\eta\cdot(N\cdot R) \quad (4).$$

Table 4 shows values of the critical pressure Pt of the liquid surface (ink meniscus) in the ink absorbing body 22, calculated in accordance with Relational Expression (4).

TABLE 4

| CR | ACD | Av. CD | Pressure | |
|---|---|---|---|---|
| R | M(N × R) | d(mm) | Px (kPa) | Px/PL |
| 2 | 3,150 | 0.32 | 0.38 | 0.82 |
| 3 | 4,724 | 0.21 | 0.57 | — |
| 4 | 6,299 | 0.16 | 0.76 | — |
| 5 | 7,874 | 0.13 | 0.94 | 1.10 |
| 5.5 | 8,661 | 0.12 | 1.04 | 1.05 |
| 6 | 9,449 | 0.11 | 1.13 | 0.98 |
| 7 | 11,024 | 0.09 | 1.32 | 1.03 |
| 8 | 12,598 | 0.08 | 1.50 | 1.00 |
| 9 | 14,173 | 0.07 | 1.70 | — |
| 10 | 15,748 | 0.06 | 1.89 | — |

Abbreviation
CR: Compression Rate
ACD: Actual Cell Density
Av. CD: Average Cell Diameter The ratio Px/PL, which is the ratio of theoretical critical pressure Px to minimum ink stable negative pressure PL (actual pressure) is substantially equal to 1. This confirms the theory that the minimum ink stable negative pressure PL depends on the critical pressure of the capillary tube generated by the surface tension of the ink, and that the minimum ink stable negative pressure PL can be accurately calculated.

A necessary condition for preventing the problem of accidental ink leakage caused when the ink cartridge 20 is inserted or detached is that the critical pressure, which is the ink retaining power of the ink absorbing body 22 (foam material), needs to be larger than the ink head pressure. That is, to prevent the above problem, the critical pressure PE (Pa) of the liquid surface (ink meniscus) in the cell 22*a* (capillary tube) of the lower end of the ink absorbing body 22 (foam material) should be larger than the ink head pressure, the critical pressure PE being the critical pressure in the cell 22*a* of the ink absorbing body 22 (foam material) and the cell 22*a* having a size (cell diameter) of 1/(N·R) by which a liquid having a surface tension of η forms a meniscus.

In the ink cartridge 20, the head pressure is $9.8\times10^3\cdot\gamma\cdot h$ (Pa) when it is assumed that the ink has a head height h(m) relative to the ink supplying outlet 24, and that the specific gravity of the ink is γ. Therefore, it is necessary that the critical pressure Pt (Pa) in Expression (9) satisfy the following condition:

$$4\cdot\eta\cdot(N\cdot R)>9.8\times10^3\cdot\gamma\cdot h.$$

That is, in order to prevent the problem of the accidental ink leakage when the ink cartridge 20 is attached or detached, the following relational Expression (13) should be satisfied:

$$\eta\cdot N\cdot R\cdot B\geqq\gamma\cdot h \quad (13),$$

where B is a coefficient $B=4.08\times10^{-4}$.

Moreover, the cell density of the ink absorbing body 22 (foam material) contained in the ink cartridge 20, that is, the actual cell density M=N·R (cells/m) (M=N·R), is given by:

$$M=1575\times5.5\times1.1=9528 \text{ (cells/m)}=242 \text{ cells/inch},$$

for example, in case where the ink absorbing body 22 (foam material) having the cell density N=1575 (cells/m) (=40 cells/inch) by being compressed at a compression rate R=5 is contained in the ink cartridge 20 thereby the ink absorbing body 22 (foam material) is compressed by another 10%. Substituting the actual cell density M (cells/m) in Relational Equation (13), the following Relational Equation (14) is given:

$$\eta\cdot M\cdot B>\gamma\cdot h \quad (14),$$

where B is a coefficient $B=4.08\times10^{-4}$. The actual cell density M used here may be a measured value.

The water head height h (m) of the ink relative to the ink supplying outlet 24 (that is, a maximum water head height h (m) in a vertical direction with respect to the ink supplying outlet 24 of the ink tank 21 under an arbitrary orientation), may be the height of the ink absorbing body 22 (foam material), or the height of inner walls of the ink cartridge 20 under usual orientation.

If different orientations of the ink cartridge 20, which the ink cartridge 20 may take as a result of handling, need to be taken into account, the head height h is the maximum vertical height relative to the ink supplying outlet 24 of the ink cartridge 20, irrespective of how the ink cartridge 20 is positioned or inclined.

Moreover, in consideration of distribution of the cell diameters, it is preferable that the safety factor is two or more. Thus, it is preferable to arrange the ink cartridge 20 to satisfy the following Relational Expression (15):

$$\eta\cdot N\cdot R\cdot B>2\cdot\gamma\cdot h \quad (15),$$

Alternatively, it is preferable to arrange the ink cartridge 20 to satisfy the following Relational Expression (16):

$$\eta\cdot M\cdot B>2\cdot\gamma\cdot h \quad (16),$$

where the coefficient $B=4.08\times10^{-4}$.

Generally, the ink cartridge has a height less than approximately 40 mm, taking into account fluctuations of the ink level. Therefore, it is preferable that the critical pressure is about 0.8 kPa (0.08 $mH_2O$) when the safety factor is 2. Thus, specifically, it is preferable that the critical pressure PE(Pa) of the cell 22*a* of the ink absorbing body 22 (foam material) satisfy PE≧800.

Thus, from Relational Expression (4), it is possible to maintain the critical pressure of the cell 22*a* of the ink absorbing body 22, that is, the retaining power of the ink absorbing body 22 (foam material) to be 0.8 kPa (800 Pa) or more by satisfying the following Relational Expression:

$$4\cdot\eta\cdot N\cdot R\geqq800 \quad (17),$$

or $$4\cdot\eta\cdot M \geqq 800 \quad (18).$$

In this way, it is possible to prevent the problem of accidental ink leakage caused when the ink cartridge 20 is inserted or detached.

Figure 18:
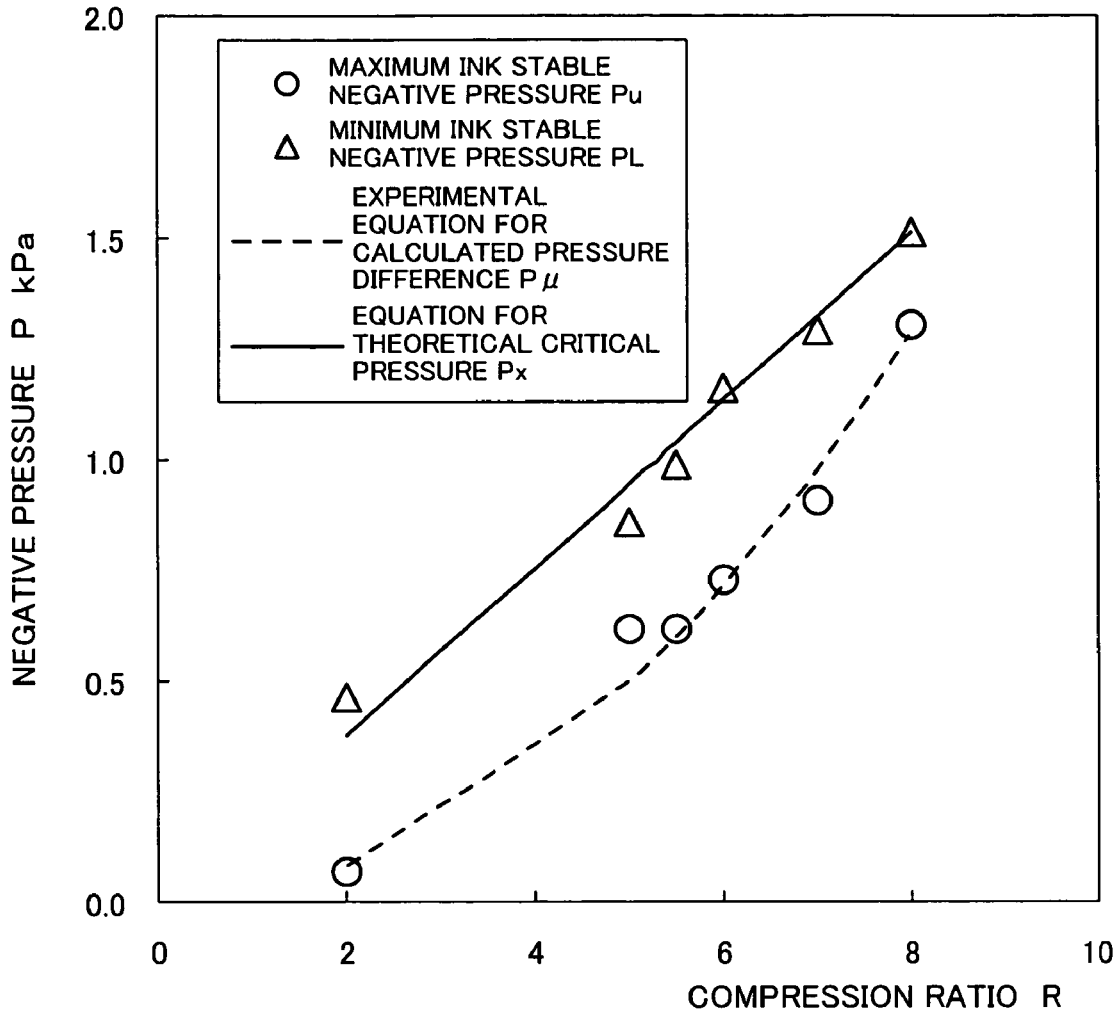
FIG. 18 is a graph showing a relationship between a compression ratio and a negative pressure.

FIG. 18 shows that the negative pressure of the theoretical values (theoretical critical pressure Px) obtained from Relational Expression (4) matches with the negative pressure (ink minimum stable negative pressure PL) actually measured. Moreover, Table 4 shows the negative pressures for each setting of the actual cell density M (M=N·R)

Next, a critical pressure Pn (hereinafter, Pn may be referred to as the critical pressure of the nozzle) is calculated that is created when the ink retreats at an orifice in response to ink ejection from an ink nozzle (ink nozzle section) 1 of the print head 1.

Note that, as shown in FIG. 21, the orifice is so shaped that an ejection nozzle of the circular tube is 20 μm in diameter and 20 μm in length, and a frustum of a circular cone is extended from an end section (nozzle end) of the spraying nozzle 1*a*, the frustum having an apical angle of 90° and a top surface diameter of 20 μm.

Assuming that the ink flow rate Q is 8.17 $nm^3/s$ (=0.49 cc/min) in a setting where sixty four ejection nozzles 1*a* of the print head 1 perform the ink ejection at an ink ejection frequency of 8000 pps, one droplet is:

$$(8.17\times10^{-9})/8000/64=1.6\times10^{-14}\ (m^3)(=16\ pL).$$

On this assumption, Table 5 shows diameter H of the cone portion measured on a liquid surface of the ink that has retreated in response to ejection of the ink. In Table 5, the diameter H=20 μm is the diameter at the tip of a nozzle that has been processed to have a sufficiently long straight portion (see FIG. 21), for example, by excimer laser processing. For an ink droplet had a volume of $1.6\times10^{-14}$ ($m^3$)(=16 pL), measurement was made under two different conditions: one not considering transient vibration of the meniscus at the end of the nozzle; and one considering transient vibration of the meniscus at the end of the nozzle so that the amount of ink retreat is twice as much as the amount of the ink ejected, as shown in FIGS. 22(*a*) through FIG. 22(*h*). FIGS. 22(*a*) to 22(*h*) are cross-sectional views illustrating, in order, how the ink is ejected from the spraying nozzle 1*a*. For example, an ink jet printer of 600 dpi requires an ink droplet of $1.6\times10^{-14}$ to $2.0\times10^{-14}$ ($m^3$) (16–20 pL).

The critical pressure Pn (Pa) of the nozzle (in the present embodiment, the spraying nozzle 1*a*) can be given as follows by substituting the diameter H (m) of the cone portion in Expression (19):

$$Pn=4\cdot\eta/H \quad (19),$$

(to say exactly, Pn≈4·η/H).

In order to prevent shortage of the ink supply, it is necessary that (Pμ)<(Pn). Where DN(m) is a diameter of the spraying nozzle 1*a*, it is necessary for prevention of the shortage of ink supply to satisfy the following Relational Expression (20), from Relational Expression (10) and Equation (19):

$$(k/A)\cdot\{\mu\cdot L\cdot(N\cdot R)^2/S\}\cdot Q<4\cdot\eta/DN \quad (20),$$

where the coefficient (k/A)=485. That is, it is necessary to satisfy the following Relational Expression (21), which is obtained from Relational Expression (20):

$$C\cdot\{\mu\cdot L\cdot Q\cdot(N\cdot R)^2/S\}<\eta/DN \quad (21),$$

where C=(k/A)/4=121.

Moreover, using the actual cell density M (cells/m) (M=N·R) in Relational Expression (21), the following relational expression is given:

$$C\cdot\{\mu\cdot L\cdot Q\cdot(M)^2/S\}<\eta/DN \quad (22),$$

where C=(k/A)/4=121.

Table 5 shows values of critical pressure Pn, calculated according to Expression (19) under different settings.

TABLE 5

| CONDITION | H(μm) | Pn(kPa) |
|---|---|---|
| NOZZLE ONLY | 20 | 6.00 |
| $1.6\times10^{-8}$ (cc) Without consideration of Excess Vibration | 42 | 2.84 |
| $1.6\times10^{-8}$ (cc) With consideration of Excess Vibration | 47 | 2.54 |

Table 5 indicates that the critical pressure Pn, which is the ink drawing force generated by the meniscus that has retreated at the end of the nozzle after the ejection of the ink, becomes larger than the negative pressure of the ink supply system when the negative pressure of the supply system is no more than approximately 2.0 kPa in continuous ejection of the ink, by taking into consideration the safety ratio, that is, errors in transient vibration and flow rate. As a result, it is possible to stably supply a necessary amount of ink even during continuous ejection of the ink.

Therefore, by so setting the negative pressure of the supply system to be no larger than approximately 2.0 kPa, it is possible to prevent the problem that the negative pressure generated by the supply system causes the shortage of the ink supply, and that the air is sucked into the nozzle by too much retreating of the liquid level of the ink from the end of the nozzle. As a result, it is possible to stably supply the ink even when continuous ejection of the ink is carried out.

If the negative pressure created in the ink supplying system is no more than 2.0 kPa, the surface tension of the meniscus prevails over the negative pressure created in the ink supplying system, thus causing the ink to be sucked in. As a result, the meniscus moves forward thereby supplying the ink. The supply of the ink is ended when the negative pressure in the ink supplying system and the sucking force of the meniscus is balanced. On the contrary, if the negative pressure created in the ink supplying system is larger than the critical pressure of the meniscus, the meniscus retreats thereby allowing the air to be sucked in and thus causing ejection failure.

Taking into consideration the efficiency t (tank efficiency), which is the ratio of the ink volume that could be ejected, with respect to the ink volume charged in the ink cartridge 20, the maximum of the actual cell density M is $12.6\times10^3$ (cells/m)(=320 cells/inch) approximately. From Table 1, the critical pressure of the ink, that is, the ink minimum stable negative pressure PL(Pa) based on the surface tension η of the ink and determined by the critical pressure PE of the liquid surface of the ink absorbing body 22, is 1.5 kPa when the cell density is as such. In general, the water head of the print head 1*a* and the water head of the ink tank 21 are set to around 40 mm. Thus, the value of approximately 2.0 kPa can be obtained from the sum of the water heads (PE+Pi).

To summarize those results, it is necessary that, in terms of the cell density N and the compression rate R, the ink absorbing body 22 (foam material) satisfy the followings:

From Relational Expression (13), the following Relational Expression (23) is given:

$$(N\cdot R)>\gamma\cdot h/(\eta\cdot B) \quad (23),$$

where the coefficient $B=4.08\times10^{-4}$. Moreover, from Relational Expression (21), the following Relational Expression (24) is given:

$$\{\eta\cdot S/(C\cdot DN\cdot\mu\cdot L\cdot Q)\}^{0.5}>(N\cdot R) \quad (24),$$

where the coefficient C=(k/A)/4=121. Therefore, from the Relational Expressions (23) and (24), the ink absorbing body 22 (foam material) is required to have the following cell density N and compression rate R:

$$\{\eta\cdot S/(C\cdot DN\cdot\mu\cdot L\cdot Q)\}^{0.5}>(N\cdot R)>\gamma\cdot h/(\eta\cdot B) \quad (25),$$

where the coefficient $B=4.08\times10^{-4}$ and the coefficient C=121.

Moreover, from Relational Expressions (14) and (22), the ink absorbing body 22 (foam material) actually mounted should have the following actual cell density M (M=N·R) (cells/m):

$$\{\eta\cdot S/(C\cdot DN\cdot\mu\cdot L\cdot Q)\}^{0.5}>M>\gamma\cdot h/(\eta\cdot B) \quad (26).$$

When the ink absorbing body 22 satisfies Relational Expressions (25) and (26), it is possible to attain prevention of the ink leakage when the ink cartridge 20 is inserted (attached) and detached, and stable supplying of the ink in the continuous ejection.

The conditions commonly adopted for the ink of ink jet printers are:

Viscosity $\mu$=0.015 to 0.15 (Pa·s);

Surface tension of the ink $\eta$=0.03 to 0.05 (N/m); and

Cell density of the foam material $N=1.57\times10^3$ to $3.94\times10^3$ (cells/m)(=40 to 100 (cells/inch)).

In view of this, for example, the following conditions were used for analysis

Viscosity $\mu$=0.015 (Pa·s),

Surface tension of the ink $\eta$=0.04 (N/m), and

Cell density of the foam material $N=3.15\times10^3$ (cells/m) (=80 (cells/inch)).

The analysis confirmed that each Relational Expression was satisfied even under the different conditions.

Next, discussed is an effect of an ink level that changes according to the consumption of the ink.

Where Ph is the head water head pressure due to a head drop h from the end of the spraying nozzle 1*a* (nozzle end) to the ink supplying outlet 24 as shown in FIG. 3, an effective retaining force Pn' (Pa) of the spraying nozzle 1*a* due to the meniscus of the ink is defined as:

$$Pn'=Pn-|Ph| \quad (27),$$

where |Ph| is an absolute value of Ph. The "|" is the sign of the absolute value. Hereinafter, "|x|" refers to an absolute value of x.

Here, in order that the meniscus of the ink may not be retreated too much from the nozzle end and the air may not be sucked in, the following Relational Expression (28) is satisfied when the ink tank 21 is full of the ink:

$$Pn'>|P\mu|-|Pi| \quad (28),$$

and the following Relational Expression (29) is satisfied when the ink tank 21 is empty of the ink:

$$Pn'>Pm \quad (29),$$

If the head water head pressure Ph (water head of the ink) is not taken into account, the condition that should be satisfied in order not to allow the air to be sucked in from the nozzle end, is Pn>Pm. However, if the head water head Ph is taken into account, the condition becomes more practical one. That is, the head water head pressure Ph is so set that the negative static pressure will be created in order to prevent the ink leakage from the nozzle end. With this setting, the ink jet recording apparatus is used with a higher possibility that the air is sucked from the nozzle end, than if the head water head pressure Ph is not taken into account. Thus, by taking into account the head water head pressure Ph, it is possible to use the ink jet recording apparatus with more practical setting.

Here, as described above, the filter 23 is generally designed as follows in order to prevent the foreign material from entering:

$$Pm>|P\mu|+|Pi| \quad (30).$$

Thus, from Relational Expressions (29) and (30), the following relationship is obtained:

$$Pn'>Pm>|P\mu|+|Pi| \quad (31).$$

Therefore, from Relational Expressions (28) and (31), the following relationship is given:

$$Pn'>Pm>|P\mu|+|Pi|>|P\mu|-|Pi|.$$

Thus, by satisfying Relational Expression (31), that is, by satisfying the following Relational Expression (32):

$$4\cdot\eta/DN-|Ph|>4\cdot\eta/(\sqrt{2}\cdot F)>|P\mu|+|Pi| \quad (32),$$

where DN (m) is the diameter of the spraying nozzle 1*a*, the pressure leaked from the filter 23 in supplying the ink, especially in supplying ink immediately before the ink is depleted, can be appropriately managed without allowing the pressure to exceed the critical pressure Pn of the spraying nozzle 1*a* of the print head 1, thereby preventing the air from being sucked in from the spraying nozzle 1*a*. Further, satisfying Relational Expression (31), that is, Relational Expression (32), it is possible to attain effective filtration of the foreign material flowing toward the ink supplying path 3, thereby allowing the ejection nozzle 1*a* to perform the ejection with a higher reliability.

Moreover, from Equation, (1), the critical pressure Pm' due to a filter having a circular opening is expressed as the following Equation (33), using the surface tension $\eta$(N/m) of the ink, and the filtration accuracy F(m):

$$Pm'=4\cdot\eta/F \quad (33).$$

Therefore, similarly to Relational Expression (32), Relational Expression (31) is expressed, by using Equation (33), as the following Relational Expression (34), $$4\cdot\eta/DN-|Ph|>4\cdot\eta/F>|P\mu|+|Pi| \quad (34).$$

Thus, in case where a filter having a circular opening is used, the satisfaction of Relational Expression (34) attains (a) that the pressure leaked from the filter 23 in supplying the ink, especially in supplying ink immediately before the ink is depleted, can be appropriately managed without allowing the pressure to exceed the critical pressure Pn of the spraying nozzle 1*a* of the print head 1, thereby preventing the air from being sucked in from the spraying nozzle 1*a*, and further (b) that the foreign material flowing toward the ink supplying path 3 can be effectively filtered out, thereby allowing the ejection nozzle 1*a* to perform the ejection with a higher reliability.

Therefore, Relational Expressions (32) and (34) are summarized as follows: In case a filter having a filtration accuracy F(m) is used in the ink supplying path 3, the ink jet recording apparatus may be so arranged as to satisfy the following Relational Expression (35), for attaining higher reliability in the ejection of the spraying nozzle 1*a:*

$$4\cdot\eta/DN-|Ph|>4\cdot\eta/F'>|P\mu|+|Pi| \quad (35),$$

where N (cells/m) is a cell density of an ink absorbing body 22 before being contained in the ink tank 21, and R is a compression ratio of the ink tank absorbing body 22 before and after being, in a compression state, contained in the ink tank 21 (F'=F in a case where the filter have circular openings, and $F'=\sqrt{2}\cdot F$ in other cases).

Note that in each relational expression and equation, especially, Relational Expressions (32), (34), (35), Pμ is given from Relational Expression (10).

Figure 23:
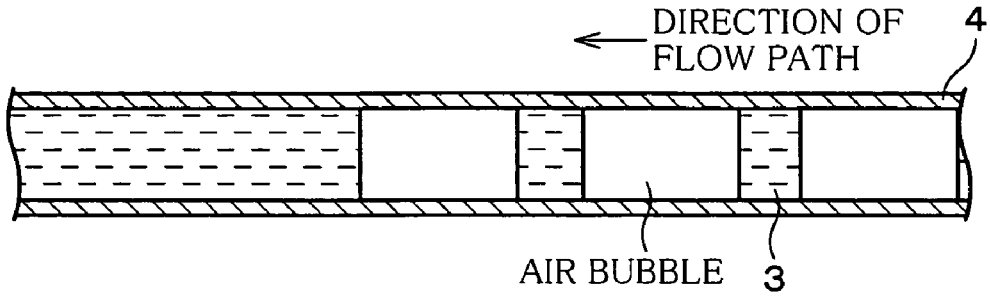
FIG. 23(*a*) is a cross sectional view of the ink supplying path showing an air bubble created in the ink supplying path when an amount of the ink supplied is small.
Figure 23:
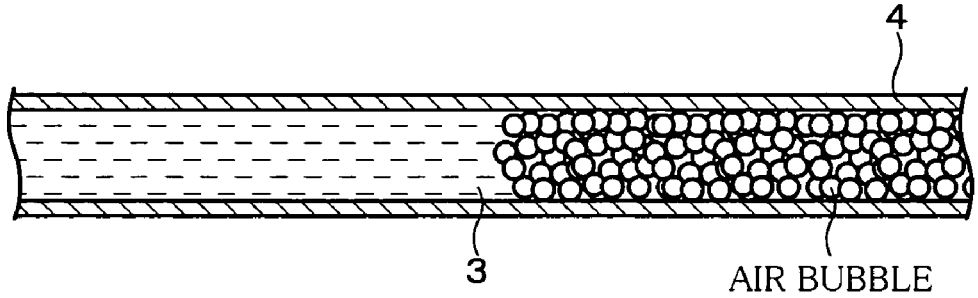

Incidentally, there is a case that, when the ink is depleted in the ink absorbing body 22 (foam material), the air, together with the ink, passes through the filter 23, thereby causing an air bubble in the supplying tube 4, that is, the ink supplying path 3, as shown in FIGS. 23(*a*) and 23(*b*).

In this case, a large air bubble is generated if the amount of the ink supplied is small, as shown in FIG. 23(*a*), where as a small air bubble is generated if the amount of the ink supplied is large. There is a case that the air bubble generated as such deteriorates the S/N ratio of the ink remaining amount detection, which is performed by using the detecting electrodes 25.

Thus, the inventors of the present invention conducted experiments on a relationship between the S/N ratio and the amount of the ink continuously supplied (continuous ink supply amount), in case a filer 23 that had a mesh-shape having a filtration accuracy F of 50 μm, was provided in an ink supplying path 3. Results of the experiments are shown in Table 6.

Note that, in each experiment discussed below, a stainless filter having a filtration accuracy F of 50 μm was used as the filter 23, a allowable amount of the air entrapped in the ink tank 21 was set at 0.5 cc. Moreover, a diameter of the ink supplying path 3 through which the ink flowed, that is an inner diameter of a pipe section upstream to a detection section (detecting electrodes 25), not including an ink supplying outlet 3*a*, in an ink supplying tube 4.

q': An amount of the ink supplied per minute (cc/min.)(ink supply amount)

Re: Reynolds number

Ro: Resistance (KΩ) of the detecting electrodes 25 when the flow rate is small.

Ra: Resistance (KΩ) of the detecting electrodes 25 in ink depletion.

S/N ratio: S/N ratio of the detection resistance of the detecting electrodes 25.

Qa: An amount (cc) of the air entrapped in the ink tank 21 (entrapped air amount).

In general, it is preferable that the S/N ratio of the detection signal is not more than 10 to 20 db (3 to 10 times), especially, is 14 db (5 times) or more. Results in which the S/N ratio is not less than 5 and the entrapped air amount Qa is not more than 0.5 cc, were judged as "good", and are labeled with "O" in Table 6, whereas results that did not satisfy those conditions were judged as "bad" and are labeled with "x" in Table 6.

TABLE 6

| ISAq' (cc/min) | R. Number Re | Resistance Ro (kΩ) | Resistance Ra (kΩ) | S/N Ratio | EAA Qa (cc) | Judge. |
|---|---|---|---|---|---|---|
| 0.05 | 0.10 | 11 | 999 | 92.5 | 0.07 | ○ |
| 0.05 | 1.01 | 11 | 58 | 5.1 | 0.08 | ○ |
| 0.05 | 1.01 | 11 | 110 | 9.6 | 0.25 | ○ |
| 2.00 | 4.04 | 11 | 26 | 2.3 | 0.67 | x |
| 2.00 | 4.04 | 11 | 45 | 3.9 | 1.33 | x |

ABBREVIATION
ISA: Ink Supply Amount
R. Number: Reynolds Number
EAA: Entrapped Air Amount
Judge.: Judgment.
○: Good
x: Not Good As shown in Table 6, when q'=0.05 (cc/min) and Re=0.10, the resistance Ra of the detecting electrodes 25 in the ink depletion is over loaded. Moreover, the S/N ratio is 5.0 in a case of the ink depletion, whereas the S/N ratio is over loaded in a case of ink presence. Thus, the result was good (satisfactory). Note that the case of the ink depletion is a state in which the ink is depleted and the meniscus of the ink retreated to the filter 23 in the ink absorbing body 22 so as to allow the air to be sucked in from the filter 23 readily. On the other hand, the case of the ink presence is a state before the ink depletion, and in which the meniscus of the ink does not reach a filter position (at which the filter 23 is provided) in the ink absorbing body 22, thus causing the filter 23 to prevent accidental sucking-in of the air.

Moreover, when q'=0.05(cc/min) and Re=1.01, good values were obtained in terms of the resistance Ra of the detecting electrodes 25 in the ink depletion, and the S/N ratio.

However, when q'=2.00(cc/min) and Re=4.04, the resistance Ra of the detecting electrodes 25 in the ink depletion was 26 kΩ in the case of the ink depletion and was 45 kΩ in case of the ink presence. Thus, the results of the resistance Ra were not good. Further, the S/N ratio was 0.67 in the case of the ink depletion and was 1.33 in the case of the ink presence. Thus, the results of the S/N ratio were not good.

Figure 1:
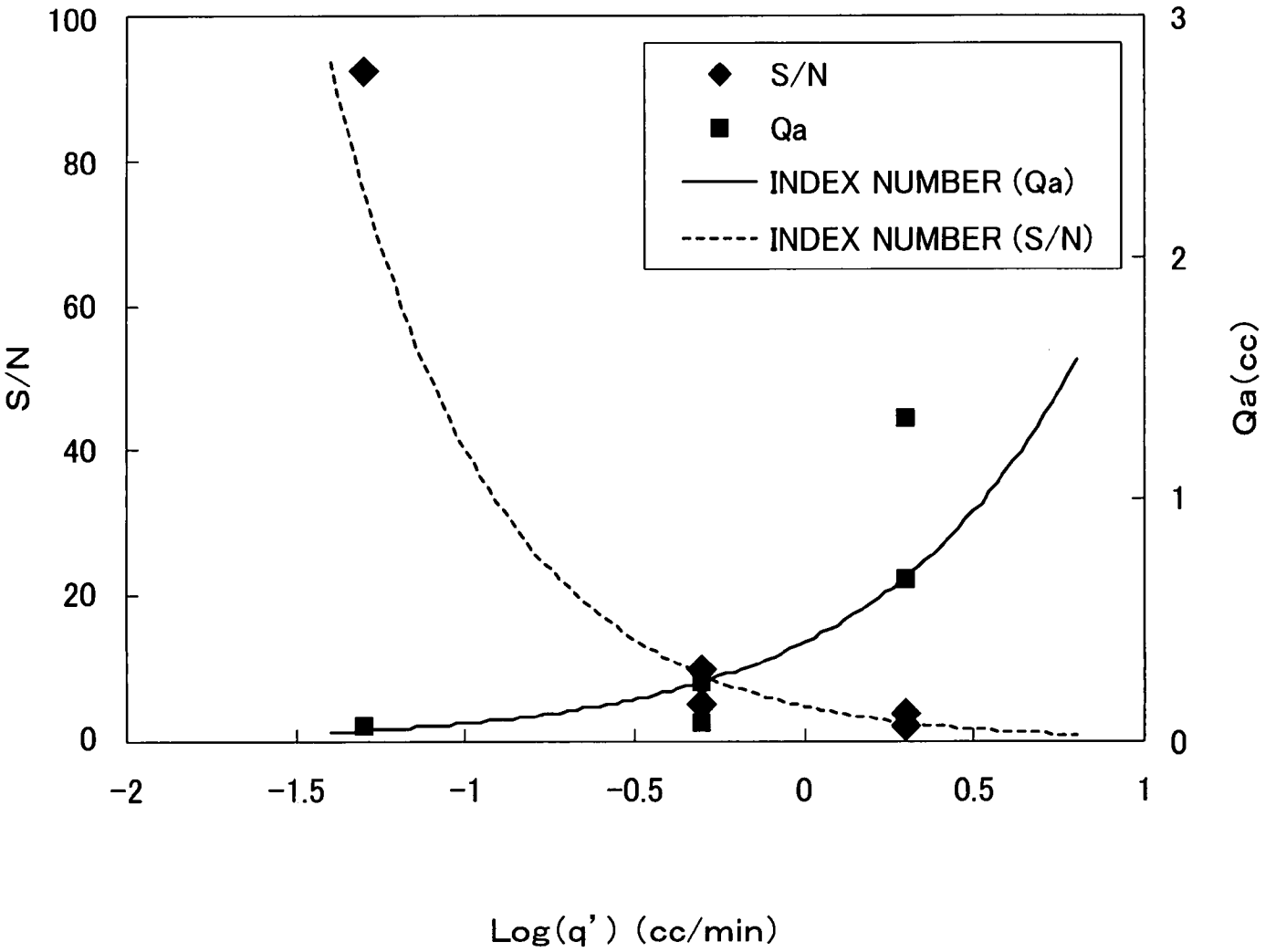
FIG. 1 is a graph illustrating a relationship between an amount of ink supplied into an ink supplying path per minute, an entrapped air amount in the ink tank, and a S/N ratio of detection electrodes, in an ink jet recording apparatus of an embodiment of the present invention.

A relationship between the ink supply amount q' (cc/min), the entrapped air amount Qa (cc) in the ink tank 21, and the S/N ratio shown in Table 8 are graphed (FIG. 1). In FIG. 1, the horizontal axis x is log of the ink supply amount q' (cc/min), that is, x=Log(q).

From FIG. 1, approximation exponential equations of the S/N ratio and the entrapped air amount Qa (cc) are as follows, as indicated by solid lines in FIG. 1:

$$S/N\approx 4.8\exp(-2.1x),$$

$$Qa\approx 0.41\exp(1.7x),$$

where $x=\mathrm{Log}(q')$.

From the approximation exponential equations, in order to satisfy S/N≧5, it is necessary that x<−0.02 (q'≦1.0). Further, in order to satisfy Q≦0.5, it is necessary that x≦0.12 (q'≦1.0). Therefore, for preventing the deterioration of the S/N value of the detecting resistance due to the air bubble and attaining stable supply of the ink, it is necessary that q'≦1 (ml/min).

Therefore, by arranging such that the ink supply amount q' to be supplied to the ink supplying path 3 (ink supplying tube 4), that is, an ink ejection amount per minute (an amount of the ink sprayed per minute) from the print head 1 is 1.0 cc/min or less, it is possible to prevent the S/N ratio of the detecting electrodes (ink depletion detection electrodes) 25 from being lowered by the air bubble generated in supplying the ink, and preventing the ink depletion detection accuracy from being lowered as a result of the ink supply.

In general, in image forming apparatuses such as the ink jet recording apparatus and the like, the ink supply amount is set to a predetermined value when the image forming apparatuses are manufactured. By setting, that is, designing such that which the ink supply amount to be supplied to the ink supplying path 3 is 1.0 cc/min or less, it is possible to provide an image forming apparatus whose ink depletion detection accuracy is not lowered even if the air bubble is present in the ink supplying path 3.

Figure 24:
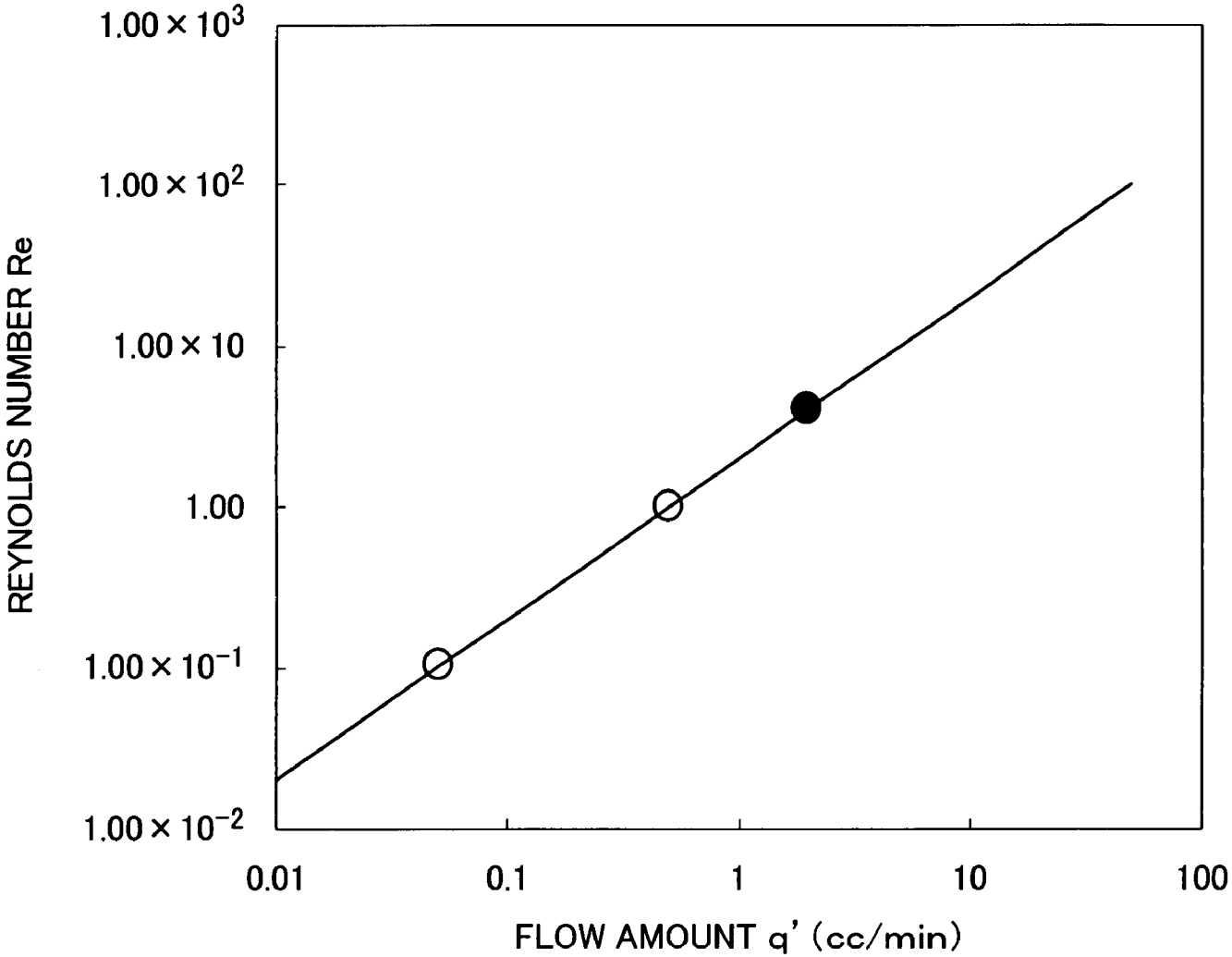
FIG. 24 is a graph showing a relationship between an amount of the ink supplied into the ink supplying path per minute, and Reynolds number.

Further, the inventors of the present invention make a graph of a relationship between the ink supply amount q' (cc/min) and the Reynolds number Re. FIG. 24 shows the graph. FIG. 24 shows that the ink supply amount $q' \leqq 1.0$ (cc/min) can be attained when the Reynolds number Re is not more than 2. Thus, by arranged such that $Re \leqq 2$, it is possible to prevent the S/N ratio of the detection resistance from being deteriorated by the air bubble.

That is, the deterioration of the S/N ratio of the detection resistance due to the air bubble can be prevented by satisfying:

$$(4 \cdot Q/(\pi \cdot d)/\nu \leqq 2 \quad (36),$$

where $\nu$ ($m^2/s$) is dynamic viscosity of the ink, d (m) is the diameter of the ink supplying path 3, and Q ($m^3/s$) is an average ink supply amount.

Further, the inventors of the present invention conducted experiments on a relationship between the ink supply amount q' and the S/N ratio in a case where a surface of the filter 23 has a water-repelling property. The filter 23 having the water-repelling property was prepared by coating, with silicon oil, the filter that was the same as the one used in the above experiments, so as to cause the surface of the filter 23 water-repelling. Results of the experiments are shown in Table 7. Note that Table 7 shows measurement in the case of the ink depletion.

TABLE 7

| ISAq' (cc/min) | Resistance Ro (kΩ) | Resistance Ra (kΩ) | S/N Ratio | EAA Qa (cc) | Judgment |
|---|---|---|---|---|---|
| 0.50 | 11.7 | 450 | 38.5 | 0.03 | ○ |
| 2.00 | 11.7 | 470 | 40.2 | 0.17 | ○ |

ABBREVIATION
ISA: Ink Supply Amount
EAA: Entrapped Air Amount
○: GOOD

From the measurement values shown in Tables 6 and 7, the S/N ratio could be improved by causing the filter 23 water-repelling, compared with the case where the ink supply amount q' was same but the filter 23 was not water-repelling (non-water-repelling, hydrophilic).

Especially, even for the ink supply amount q' of 2.0 cc/min in which the S/N ratio of the detection resistance was dramatically deteriorated where the filer 23 has no water-repelling property as shown in Table 6, the S/N ratio became 40.2 by arranging the filter 23 to have a water-repelling property, as shown in Table 7. Thus, the arrangement in which the filer 23 has the water-repelling property gave good results.

Figure 25:
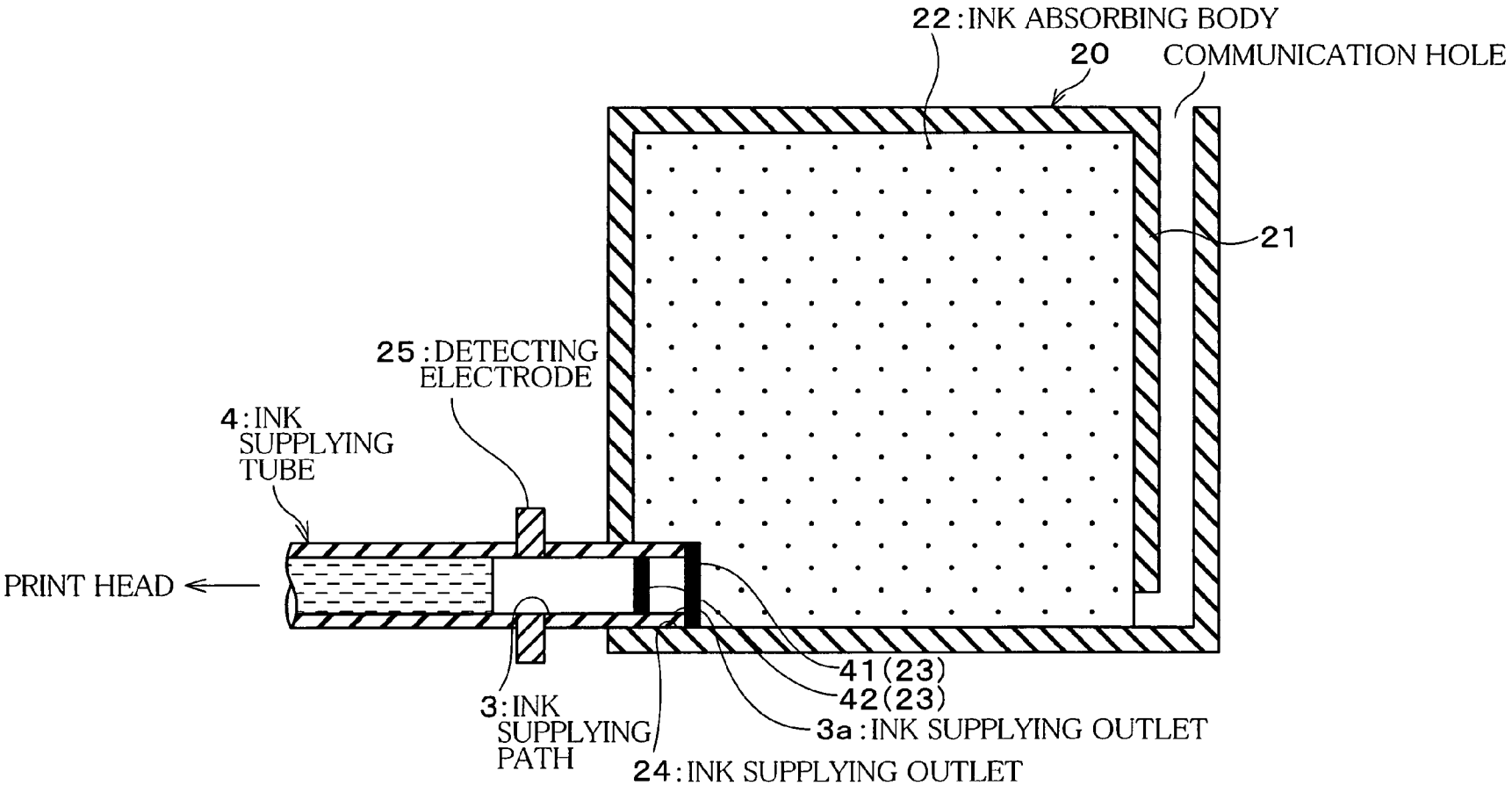
FIG. 25 is a cross sectional view illustrating an arrangement of an ink cartridge in which two filters are provided in an ink supplying path of the ink jet recording apparatus.

Moreover, the inventors of the present invention conducted experiments on a relationship between filter accuracies $F_1$ and $F_2$ of each filter and the ink supply amount q' or the S/N ratio, in an arrangement where two filters 41 (first filter) and 42 (second filter) were provided, as the filter 23, in the ink supplying path 3 as shown in FIG. 25. Results of the experiments are shown in Table 8.

TABLE 8

| FILTRATION ACCURACY | | | | Ink Supply Amount q' | Resistance Ro | Resistance Ra | S/N | Entrapped Air Amount Qa | |
|---|---|---|---|---|---|---|---|---|---|
| $F_1$(μm) | $F_2$(μm) | Surface | Condition | (cc/min) | (kΩ) | (kΩ) | Ratio | (cc) | Judgment |
| 50 | 50 | Water | INITIAL | 0.50 | 14 | 800 | 58.8 | 0.03 | ○ |
| | | Repelling | | 2.00 | 13 | 166 | 13.2 | 0.17 | ○ |
| | | | LEFT | 0.50 | 12 | 80 | 6.5 | 0.05 | ○ |
| | | | | 2.00 | 13 | 70 | 5.2 | 0.67 | x |
| 50 | 70 | Non | INITIAL | 0.50 | 25 | OL | OL | 0.05 | ○ |
| | | Water- | | 2.00 | 25 | OL | OL | 0.33 | ○ |
| | | Repelling | LEFT | 0.50 | 25 | OL | OL | 0.03 | ○ |
| | | | | 2.00 | 26 | 240 | 9.2 | 0.33 | ○ |
| 50 | 95 | Non | INITIAL | 0.50 | 25 | OL | OL | 0.05 | ○ |
| | | Water | | 2.00 | 25 | 120 | 4.8 | 0.67 | x |
| | | Repelling | LEFT | 0.50 | 25 | OL | OL | 0.03 | ○ |
| | | | | 2.00 | 26 | 90 | 3.5 | 0.67 | x |
| 50 | 115 | Non | INITIAL | 0.50 | 25 | OL | OL | 0.10 | ○ |
| | | Water | | 2.00 | 26 | 340 | 13.1 | 0.67 | x |
| | | Repelling | LEFT | 0.50 | 26 | 500 | 19.2 | 0.10 | ○ |
| | | | | 2.00 | 26 | 90 | 3.5 | 0.67 | x |

Note that, in Table 8, $F_1$ is the filer accuracy of the filter 41 located in an upstream side in the ink supplying path 3, $F_2$ is the filter accuracy of the filter 42 located in a downstream side in the ink supplying path 3, ○ is good, x is not good, and OL is "over load". Moreover, OL (over load) indicates a reading that was beyond a scale of a resistance meter and could not be measured (999 kΩ or higher).

Moreover, "INITIAL" is a case where the experiment was started right after filling a new and empty ink tank 21 up with ink. "LEFT" is a case where the experiment was started 3 days later from the filling a new and empty tank 21 up with ink. "AFTER INK SUPPLY" is a case where the experiment was carried out with a used and empty ink tank 21 filled up to be in a normal state.

As shown in Table 8, again in the arrangement in which the two filters were provided in the ink supplying path 3, for example, in order to prevent the ink leakage and to remove the foreign material, good results (S/N ratio≧5, entrapped air amount Qa≦0.5 cc) were obtained in the experiments, regardless of whether the filter 23 was water-repelling or not, by setting the ink supply amount q' at 1.0 cc/min or less.

Moreover, in Table 8, the filtration accuracy $F_2$ of the filter 42 located on the downstream side was set to be equal or higher than the filtration accuracy $F_1$ of the filter 41 located on the upstream side. As shown in Table 8, a good S/N ratio was obtained especially when the filtration accuracy $F_2$ of the filter 42 located on the downstream side was 70 μm and the filtration accuracy $F_1$ of the filter 42 located on the upstream side was 50 μm.

Moreover, Table 9 shows the relationships between the filtration accuracy $F_1$ (F) and $F_2$ of the filters, and the ink supply amount q' and the S/N ratio.

TABLE 9

| FILTRATION ACCURACY | | | INITIAL JUDGMENT | | JUDGMENT AFTER LEFT | |
|---|---|---|---|---|---|---|
| | | | q' = 0.5 | q' = 2 | q' = 0.5 | q' = 2 |
| $F_1$(μm) | $F_2$(μm) | SURFACE | (cc/min) | (cc/min) | (cc/min) | (cc/min) |
| 50 | N/A | N-WP | ○ | x | ○ | x |
| | | WP | ○ | ○ | ○ | x |
| 50 | 50 | N-WP | ○ | x | x | x |
| | | WP | ○ | ○ | ○ | x |
| 50 | 70 | N-WP | ○ | ○ | ○ | ○ |
| 50 | 95 | N-WP | ○ | x | ○ | x |
| 50 | 115 | N-WP | ○ | x | ○ | x |

ABBREVIATION
N-WP: Non-Water Repelling
WP: Water Repelling
○: Good
x: Not Good

As shown in Table 9, in case where $F_1$ was 50 μm and $F_2$ was 50 μm, the S/N ratio or the entrapped air amount was not good. On the other hand, when $F_1$ was 50 μm and $F_2$ was 95 μm or 115 μm, good S/N ratios, or good entrapped air amounts were obtained, except that the entrapped air amount was not good in the case where the ink supply amount q' was 2.00 cc/min.

Therefore, from those results, again by arranging such that the filtration accuracy $F_2$(m) of the filter 42 located on the downstream side is larger than the filtration accuracy $F_1$ of the filter 41 located on the upstream side, it is possible to prevent deterioration in the S/N ratio of the detection resistance due to air bubbles, or in entrapped air amount. Thus, it is possible to provide an image forming apparatus in which the ink depletion detection accuracy will not be deteriorated by the air bubble created in the ink supplying path 3.

Further, in this case, especially, by arranging such that $F_2$(m) is larger than $F_1$ by a factor of $\sqrt{2}$ or less (that is $F_1<F_2\leqq\sqrt{2}\,F_1$), preferably by a factor of less than $\sqrt{2}$, it is possible to attain effective prevention of the deterioration of the S/N ratio of the detection resistance due to the air bubbles. Thus, it is possible to more effectively prevent the reduction of the ink depletion detection accuracy.

Especially, as shown in Tables 8 and 9, when $F_1$ was 50 μm and $F_2$ was 70 μm, a good S/N ratio could be obtained even if the ink supply amount q' is 2.00 cc/min or even in case of "LEFT".

This is because the $F_2$ was set to be $\sqrt{2}$ times larger than $F_1$, so that the air bubbles generated in passing the filter 41 located on the upstream side were trapped by the filter 42 located on the downstream side.

Here, from the fact that the critical pressure Pm of the ink negative pressure of the filter 41, which is identical with the filter 23, is expressed as $Pm=4\eta/(\sqrt{2}\cdot F_1)$ from the Experimental Equation (2), it is considered that the air bubble had a diameter $D_B$ (m) which was $\sqrt{2}$ times larger than the filtration accuracy $F_1$, right after passing the filter 41 located on the upstream side. The diameter $D_B$ of the air bubble can be obtained by calculating back from the measurement value of the critical pressure Pm that breaks the meniscus of the ink at the opening section of the filter. The measurement values of the critical pressure Pm was obtained by using the measurement apparatus shown in FIG. 8.

Here, where, similarly to the above, it is interpreted that the filtration accuracy $F_1$ is the most small section of the opening section (cell) of the filter 41 located on the upstream side, the air bubble created by passing through the filter 41 would not be trapped by the filter 42 if $F_2$ was larger than the diameter $D_B$, that is, was greater than $(\sqrt{2}\cdot F_1)$, and this would thus cause deterioration of the S/N ratio of the detecting electrodes 25. $F_2$ that is two times or more greater than $F_1$, tends to cause this problem more often.

Therefore, it is preferable that the filtration accuracy $F_2$ of the filter 42 located on downstream side is larger than the filtration accuracy $F_1$ by a factor of not more than 2. It is more preferable that the filtration accuracy $F_2$ of the filter 42 located on downstream side is larger than the filtration accuracy $F_1$ by a factor of $\sqrt{2}$ or less, that is, $F_2$ is not more than $D_B$ (in other words, $F_1<F_2\leqq D_B$).

Moreover, a greater ratio at which $F_2$ is smaller than $F_1$ gives smaller diameter $D_B'$ ($D_B'=\sqrt{2}\cdot F_2$) of an air bubble created by the filter 42 on the downstream side after the air bubble created by the filter 41 on the upstream side passes the filter 42. Thus, the greater ratio at which $F_2$ is smaller than $F_1$ leads to a lower S/N ratio of the ink detecting electrodes thereby reducing an ink depletion detection accuracy.

This is because a larger air bubble is more fragile (easy to be broken). Thus, the larger the air bubble, the better the S/N ratio of the ink detection resistance.

Thus, as described above, it is preferable that the filtration accuracy $F_2$(m) of the filter 42 located on the downstream side is greater than the filtration accuracy $F_1$ (m) of the filter 41 located on the upstream side. With this arrangement, it is possible to prove an image forming apparatus in which ink depletion detection accuracy will not be deteriorated even if an air bubble is created in the ink supplying path 3.

Note that it is preferable that meshes (cells) of the filters 41 and 42, that is, meshes (cells) are not round (circular) in shape, in other words, have a shape other than the round shape. For example, it is preferable that the meshes of the filter 23 are ellipse in shape or formed in a mesh shape. With this arrangement, it is possible to create an air bubble larger than the filtration accuracies $F_1$ and $F_2$ (F) of the filters 41 and 42 (filter 23), after the ink passes the filters 41 and 41 (Filter 23).

Note that the present invention is not limited to the above embodiment, and may be modified in various ways within the scope of the claims. The technical scope of the present invention includes embodiments that is attained by combination of technical means that is appropriately modified within the scope of the claims.

The embodiment described above is so discussed that N(cells/m) is the cell density of the ink absorbing body ink absorbing body (ink absorbing body 22) before contained in the ink tank 21, that is, in the ink storage section, and R is the compression ratio that is a ratio between (a) a volume of the ink absorbing body after contained in the ink storage section, and (b) a volume of the ink absorbing body before contained in the ink storage section. However, the ink absorbing body may be compressed in entering the ink absorbing body in the ink storage, or may be compressed in advance before entering the ink absorbing body in the ink storage.

The ink absorbing body may be, for example, a compressible sponge or the like, or a compressible foam material (permanently compressed by thermal pressing when in a compression state), which is widely used as an ink absorbing body. In this case, the cell density N (cells/m) and the compression rate R are a cell density (cells/m) of an ink absorbing body before compressed, and a volumetric ratio of the ink absorbing body before and after being compressed, that is, a volumetric ratio of the ink absorbing body in inserting (entering) the compressed foam material, as the ink absorbing body, in the ink tank.

Thus, in each of the equations and expressions discussed above, N=N' and R=R', where N' (cells/m) is the cell density before compressed, and R' is a ratio between (a) a volume of the ink absorbing body after compressed, and (b) a volume of the ink absorbing body before compressed.

As described above, the image forming apparatus of the present invention is so arranged as to include an ink absorbing body (for example, a foam material) in the ink storage section, the ink absorbing body retaining the ink; and a filter (for example, a filter provide at that end of the ink supplying path which is associated with the ink storage section) in the ink supplying path, the image forming apparatus satisfying:

$$4\cdot\eta/DN-|Ph|>4\cdot\eta/F'\geqq|P\mu|+|Pi|,$$

where:

$$P\mu=(k/a)\cdot\{\mu\cdot L\cdot(N\cdot R)^2/S\}\cdot Q.$$

Ph(Pa) is a water head pressure between an ink spraying outlet of a nozzle (ink spraying nozzle) of the print head and an ink supply outlet of the ink storage section, Pi(Pa) is a water head pressure created in the ink storage section in supplying the ink to the print head via the ink supply outlet of the ink storage section when the ink storage section is full of the ink, Pμ(Pa) is a pressure loss due to viscous drag of the ink in the ink storage section, F(m) is a filtration accuracy of the filter, DN(m) is a diameter of the nozzle of the print head, η(N/m) is a surface tension of the ink, N is a cell density of the ink absorbing body before being contained in the ink storage section, R is a compression ratio that is a ratio between (a) a volume of the ink absorbing body after contained in the ink storage section, and (b) a volume of the ink absorbing body before contained in the ink storage section, $S(m^2)$ is a cross section area of the ink absorbing body contained in the ink storage section in a compression state, and L(m) is a height of the ink absorbing body contained in the ink storage section in a compression state, (where coefficient (k/A)=485, and F'=F in case the filter has round openings, or $F'=\sqrt{2}\cdot F$ in an other case).

According to the arrangement, the pressure leaked from the filter 23 in supplying the ink, especially in supplying ink immediately before the ink is depleted, can be appropriately managed without allowing the pressure to exceed the critical pressure of the spraying nozzle of the print head, thereby (a) preventing the air from being sucked in from the spraying nozzle, and further (b) effectively filtering out the foreign material flowing toward the ink supplying path. Thus, this arrangement attains a higher reliability of the ejection nozzle in performing the ejection.

The image forming apparatus of the present invention may be so arranged that a filter in the ink supplying path, the filter having a water-repelling property.

The inventors of the present invention confirmed that, even though the ink supply amounts are the same, the use of the filter having the water-repelling property effected that the S/N ratio of the detecting electrode is improved compared with the arrangement in with the filter used therein did not have the water-repelling property. Thus, according to the arrangement, it is possible to effectively prevent the ink depletion detection accuracy from being lowered by the supply of the ink.

The image forming apparatus of the present invention is so arranged that:

$$F_1<F_2\leqq\sqrt{2}F_1,$$

where $F_1$(m) is a filtration accuracy of the first filter, and $F_2$(m) is a filtration accuracy of the second filter.

If it is so arranged that $F_2$ is greater than $F_1$, it is possible to give a large diameter to the air bubble created by the second filter. However, if $F_2$ is larger than the diameter of the air bubble, the air bubble created when the ink passes the first filter is not trapped by the second filter but is allowed to pass through the second filter. This causes low S/N ratio of the detection electrode. When $F_2$ is greater than $F_1$ by $\sqrt{2}$, this problem of allowing the air bubble to pass through the second filter is more sever. Thus, by arranging such that $F_2$ is equal to or smaller than a $\sqrt{2}$ multiple of $F_1$, it is possible to more effectively prevent the S/N ratio of the detecting electrode from being low. Thus, it is possible to more effectively prevent the deterioration of the ink depletion detection accuracy.

The image forming apparatus of the present invention is so arranged that:

$$F_1<F_2\leqq D_B,$$

where $F_2$(m) is a filtration accuracy of the second filter, and $D_B$(m) is a diameter of an air bubble created when an air bubble created in the ink supplying path passes through the first filter.

If it is so arranged that $F_2$ is greater than $F_1$, it is possible to give a large diameter to the air bubble created by the second filter. However, if $F_2$ is larger than the diameter $D_B$ of the air bubble, the air bubble created when the ink passes the first filter is not trapped by the second filter but is allowed to pass through the second filter. This causes low S/N ratio of the detection electrode. Thus, by arranging such that $F_2$ is equal to or smaller than $D_B$, it is possible to more effectively prevent the S/N ratio of the detecting electrode from being low. Thus, it is possible to more effectively prevent the deterioration of the ink depletion detection accuracy.

The image forming apparatus of the present invention is so arranged that at least one of the first and second filters has a water-repelling property.

The experiments conducted by the inventors of the present invention found that, even though the ink supply amounts are the same, the use of the filter having the water-repelling property effected that the S/N ratio of the detecting electrode is improved compared with the arrangement in with the filter used therein did not have the water-repelling property. Thus, the arrangement in which at least one of the first and second filters has the water-repelling property, effectively prevents the ink depletion detection accuracy from being lowered by the ink supply.

The image forming apparatus of the present invention is so arranged as to include an ink cartridge that is detachable, the ink cartridge containing the ink storage section inside thereof; and an ink absorbing body in the ink storage section, the ink absorbing body being porous and retaining the ink therein, the image forming apparatus satisfying:

$$\eta \cdot N \cdot R \cdot B > 2 \cdot \gamma \cdot h,$$

where: η (N/m) is a surface tension of the ink,

N(cells/m) is a cell density of the ink absorbing body before contained in the ink storage section, R is a compression ratio that is a ratio between (a) a volume of the ink absorbing body after contained in the ink storage section, and (b) a volume of the ink absorbing body before contained in the ink storage section, γ is a specific gravity of the ink, h (m) is a maximum water head of the ink in a perpendicular direction with respect to an ink supply outlet of the ink storage section under arbitrary orientation, and B is a coefficient=$4.08\times10^{-4}$.

When $\eta \cdot N \cdot R \cdot B > 2 \cdot \gamma \cdot h$, it is possible to attain a retaining force greater than the maximum water head pressure of the ink created under arbitrary orientation, taking into consideration the difference in the surface tension η of the ink. Thus, it is possible to more surly prevent the problem of the accidental leakage of the ink in inserting and detaching the ink cartridge. Moreover, the continuous ejection of the ink can be performed with a negative pressure of the ink supply system less than the sucking pressure of the ink caused by the ink meniscus at the nozzle end from which the ink is ejected. Thus, it is possible to prevent failure in ejection of the ink, which is caused by sucking the air in due to too much retreat of the ink liquid surface from the nozzle end as a result of the shortage of the ink supply due to the negative pressure created in the ink supply system.

The invention being thus described, it will be obvious that the same way may be varied in many ways. Such variations are not to be regarded as a departure from the spirit and scope of the invention, and all such modifications as would be obvious to one skilled in the art are intended to be included within the scope of the following claims.

What is claimed is:

1. An image forming apparatus, comprising:

an ink storage section for storing ink therein;

an ink supplying path for supplying, to a print head, the ink stored in the ink storage section; and an electrode for detecting whether the ink is present or absent in the ink supplying path, wherein an amount of the ink supplied into the ink supplying path per minute is set such that a signal to noise ratio of a detection signal produced by the electrode is not lowered even when an air bubble is created in the ink supplying path, and such that an ink depletion accuracy of the electrode is not lowered even if an air bubble is created in the ink supplying path.

2. The image forming apparatus as set forth in claim 1, comprising:

a filter in the ink supplying path, the filter having a water-repelling property.

3. The image forming apparatus as set forth in claim 2, wherein:

the filter has a mesh shape.

4. The image forming apparatus as set forth in claim 1, comprising:

an ink cartridge that is detachable, the ink cartridge containing the ink storage section inside thereof; and an ink absorbing body in the ink storage section, the ink absorbing body being porous and retaining the ink therein, the image forming apparatus satisfying:

$$\eta \cdot N \cdot R \cdot B > 2\gamma \cdot h,$$

where η (N/m) is a surface tension of the ink, N(cells/m) is a cell density of the ink absorbing body before contained in the ink storage section, R is a compression ratio that is a ratio between (a) a volume of the ink absorbing body after contained in the ink storage section, and (b) a volume of the ink absorbing body before contained in the ink storage section, γ is a specific gravity of the ink, h (m) is a maximum water head of the ink in a perpendicular direction with respect to an ink supply outlet of the ink storage section under arbitrary orientation, and B is a coefficient=$4.08\times10^{-4}$.

5. The image forming apparatus as set forth in claim 1, wherein the amount of the ink supplied into the ink supplying path is 1.0 cc or less per minute.

6. An image forming apparatus, comprising:

an ink storage section for storing ink therein;

an ink supplying path for supplying, to a print head, the ink stored in the ink storage section; and an electrode for detecting whether the ink is present or absent in the ink supplying path, the image forming apparatus satisfying:

$$(4 \cdot Q/(\pi \cdot d))/\nu \leqq 2,$$

where $\nu(m^2/s)$ is a dynamic viscosity of the ink, d(m) is a diameter of the ink supplying path, Q ($m^3/s$) is an average ink supply amount.

7. The image forming apparatus as set forth in claim 6, comprising:

an ink absorbing body in the ink storage section, the ink absorbing body retaining the ink; and a filter in the ink supplying path, the image forming apparatus satisfying:

$$4 \cdot \eta / DN - |Ph| > 4 \cdot \eta / F' \geqq |P\mu| + |Pi|,$$

where:

$P\mu = (k/a) \cdot \{\mu \cdot L \cdot (N \cdot R)^2 / S\} \cdot Q.$

Ph(Pa) is a water head pressure between an ink spraying outlet of a nozzle of the print head and an ink supply outlet of the ink storage section, Pi(Pa) is a water head pressure created in the ink storage section in supplying the ink to the print head via the ink supply outlet of the ink storage section when the ink storage section is full of the ink, Pμ(Pa) is a pressure loss due to viscous drag of the ink in the ink storage section, F(m) is a filtration accuracy of the filter, DN(m) is a diameter of the nozzle of the print head, η(N/M) is a surface tension of the ink, N is a cell density of the ink absorbing body before being contained in the ink storage section, R is a compression ratio that is a ratio between (a) a volume of the ink absorbing body after contained in the ink storage section, and (b) a volume of the ink absorbing body before contained in the ink storage section, $S(m^2)$ is a cross section area of the ink absorbing body contained in the ink storage section in a compression state, and L(m) is a height of the ink absorbing body contained in the ink storage section in a compression state, (where coefficient (k/A)=485, and F'=F in case the filter has round openings, or $F'=\sqrt{2}\cdot F$ in an other case).

8. The image forming apparatus as set forth in claim 6, comprising:

a filter in the ink supplying path, the filter having a water-repelling property.

9. The image forming apparatus as set forth in claim 8, wherein:

the filter has a mesh shape.

10. The image forming apparatus as set forth in claim 6, comprising:

an ink cartridge that is detachable, the ink cartridge containing the ink storage section inside thereof; and an ink absorbing body in the ink storage section, the ink absorbing body being porous and retaining the ink therein, the image forming apparatus satisfying:

$$\eta\cdot N\cdot R\cdot B>2\cdot\gamma\cdot h,$$

where: η(N/m) is a surface tension of the ink,

N(cells/m) is a cell density of the ink absorbing body before contained in the ink storage section, R is a compression ratio that is a ratio between (a) a volume of the ink absorbing body after contained in the ink storage section, and (b) a volume of the ink absorbing body before contained in the ink storage section, γ is a specific gravity of the ink, h (m) is a maximum water head of the ink in a perpendicular direction with respect to an ink supply outlet of the ink storage section under arbitrary orientation, and B is a coefficient=$4.08\times10^{-4}$.

11. An image forming apparatus, comprising:

an ink storage section for storing ink therein;

an ink supplying path for supplying, to a print head, the ink stored in the ink storage section;

an electrode for detecting whether the ink is present or absent in the ink supplying path; and first and second filters in the ink supplying path, the first and second filters having different filtration accuracies, the first filter located upstream to the second filter, the second filter has a larger filtration accuracy than the first filter, wherein $$F_1<F_2\leqq\sqrt{2}F_1,$$

wherein $F_1$(m) is a filtration accuracy of the first filter, and $F_2$(m) is a filtration accuracy of the second filter.

12. The image forming apparatus as set forth in claim 11 wherein:

an amount of the ink supplied into the ink supplying path is 1.0 cc or less per minute.

13. The image forming apparatus as set forth in claim 11, wherein:

at least one of the first and second filters has a water-repelling property.

14. The image forming apparatus as set forth in claim 11, comprising:

an ink cartridge that is detachable, the ink cartridge containing the ink storage section inside thereof; and an ink absorbing body in the ink storage section, the ink absorbing body being porous and retaining the ink therein, the image forming apparatus satisfying:

$$\eta\cdot N\cdot R\cdot B>2\cdot\gamma\cdot h,$$

where: η(N/m) is a surface tension of the ink,

N(cells/m) is a cell density of the ink absorbing body before contained in the ink storage section, R is a compression ratio that is a ratio between (a) a volume of the ink absorbing body after contained in the ink storage section, and (b) a volume of the ink absorbing body before contained in the ink storage section, γ is a specific gravity of the ink, h (m) is a maximum water head of the ink in a perpendicular direction with respect to an ink supply outlet of the ink storage section under arbitrary orientation, and B is a coefficient=$4.08\times10^{-4}$.

15. The image forming apparatus as set forth in claim 11, wherein:

at least one of the first and second filters has a mesh shape.

16. An image forming apparatus, comprising:

an ink storage section for storing ink therein;

an ink supplying path for supplying, to a print head, the ink stored in the ink storage section;

an electrode for detecting whether the ink is present or absent in the ink supplying path; and first and second filters in the ink supplying path, the first and second filters having different filtration accuracies, the first filter located upstream to the second filter, the second filter has a larger filtration accuracy than the first filter, wherein:

$$F_1<F_2\leqq D_B,$$

where $F_1$(m) is a filtration accuracy of the first filter, $F_2$(m) is a filtration accuracy of the second filter, and $D_B$(m) is a diameter of an air bubble created when an air bubble created in the ink supplying path passes through the first filter.

17. The image forming apparatus as set forth in claim 16 wherein:

an amount of the ink supplied into the ink supplying path is 1.0 cc or less per minute.

18. The image forming apparatus as set forth in claim 16 wherein:

at least one of the first and second filters has a water-repelling property.

19. The image forming apparatus as set forth in claim 16, comprising:

an ink cartridge that is detachable, the ink cartridge containing the ink storage section inside thereof; and an ink absorbing body in the ink storage section, the ink absorbing body being porous and retaining the ink therein, the image forming apparatus satisfying:

$$\eta \cdot N \cdot R \cdot B > 2 \cdot \gamma \cdot h,$$

where: η (N/m) is a surface tension of the ink,

N(cells/m) is a cell density of the ink absorbing body before contained in the ink storage section, R is a compression ratio that is a ratio between (a) a volume of the ink absorbing body after contained in the ink storage section, and (b) a volume of the ink absorbing body before contained in the ink storage section, γ is a specific gravity or the ink, h (m) is a maximum water head of the ink in a perpendicular direction with respect to an ink supply outlet of the ink storage section under arbitrary orientation, and B is a coefficient=$4.08\times10^{-4}$.

20. The image forming apparatus as set forth in claim 16 wherein:

at least one of the first and second filters has a mesh shape.

21. An image forming apparatus, comprising:

an ink storage section for storing ink therein;

an ink supplying path for supplying, to a print head, the ink stored in the ink storage section;

an electrode for detecting whether the ink is present or absent in the ink supplying path;

first and second filters in the ink supplying path, the first and second filters having different filtration accuracies, the first filter located upstream to the second filter, the second filter has a larger filtration accuracy than the first filter;

an ink cartridge that is detachable, the ink cartridge containing the ink storage section inside thereof; and an ink absorbing body in the ink storage section, the ink absorbing body being porous and retaining the ink therein, the image forming apparatus satisfying:

$$\eta \cdot N \cdot R \cdot B > 2 \cdot \gamma \cdot h.$$

where: η(N/m) is a surface tension of the ink,

N(cells/m) is a cell density of the ink absorbing body before contained in the ink storage section, R is a compression ratio that is a ratio between (a) a volume of the ink absorbing body after contained in the ink storage section, and (b) a volume of the ink absorbing body before contained in the ink storage section, γ is a specific gravity of the ink, h (m) is a maximum water head of the ink in a perpendicular direction with respect to an ink supply outlet of the ink storage section under arbitrary orientation, and B is a coefficient=$4.08\times10^{-4}$.

* * * * *